US006875549B2

(12) United States Patent
Yamazaki et al.

(10) Patent No.: US 6,875,549 B2
(45) Date of Patent: Apr. 5, 2005

(54) DRY TONER, TONER PRODUCTION PROCESS, IMAGE FORMING METHOD AND PROCESS CARTRIDGE

(75) Inventors: Katsuhisa Yamazaki, Numazu (JP); Hirohide Tanikawa, Suntoh-gun (JP); Hiroshi Yusa, Tokyo (JP); Takashige Kasuya, Suntoh-gun (JP); Yoshihiro Ogawa, Suntoh-gun (JP); Shuhei Moribe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 10/117,232

(22) Filed: Apr. 8, 2002

(65) Prior Publication Data

US 2003/0036008 A1 Feb. 20, 2003

(30) Foreign Application Priority Data

Apr. 10, 2001 (JP) ..... 2001-111090

(51) Int. Cl.[7] ..... G03G 9/083

(52) U.S. Cl. ..... 430/106.1; 430/106.2; 430/111.4; 430/110.3; 430/110.4; 430/137.2; 430/120; 430/126

(58) Field of Search ..... 430/137.2, 120, 430/126, 106.1, 106.2, 110.3, 110.4, 111.4

(56) References Cited

U.S. PATENT DOCUMENTS

| | | | | |
|---|---|---|---|---|
| 4,132,634 | A | 1/1979 | Rumpf et al. | 209/136 |
| 4,146,082 | A | 3/1979 | Granger | 164/254 |
| 4,153,541 | A | 5/1979 | Rumpf et al. | 209/143 |
| 4,206,064 | A | 6/1980 | Kiuchi et al. | 430/166 |
| 4,404,271 | A | 9/1983 | Kawagushi et al. | 430/110 |
| 4,844,349 | A | 7/1989 | Kanda et al. | 241/19 |
| 5,240,803 | A | 8/1993 | Ota | 430/106 |
| 5,641,601 | A | 6/1997 | Mitani et al. | 430/106.6 |
| 5,800,959 | A | 9/1998 | Ikami | 430/126 |
| 5,912,101 | A | 6/1999 | Karaki et al. | 430/110 |
| 5,935,753 | A | 8/1999 | Ohishi et al. | 430/111 |
| 6,033,817 | A | 3/2000 | Yusa et al. | 430/106.6 |
| 6,060,202 | A | 5/2000 | Ogawa et al. | 430/111 |
| 6,238,834 | B1 | 5/2001 | Tamura et al. | 430/106.6 |
| 6,537,715 | B2 * | 3/2003 | Mizoo et al. | 430/110.3 |
| 6,586,151 | B1 * | 7/2003 | Naka et al. | 430/110.4 |

FOREIGN PATENT DOCUMENTS

| | | |
|---|---|---|
| EP | 0881544 | 12/1996 |
| EP | 1091257 | 4/2001 |
| JP | 41-20153 | 11/1966 |
| JP | 42-27596 | 12/1967 |
| JP | 44-6397 | 3/1969 |
| JP | 45-26478 | 9/1970 |
| JP | 50-133838 | 10/1975 |
| JP | 54-24745 | 8/1979 |
| JP | 55-6433 | 2/1980 |
| JP | 55-42752 | 11/1980 |
| JP | 58-7384 | 2/1983 |
| JP | 58-41508 | 9/1983 |
| JP | 59-7385 | 2/1984 |
| JP | 63-101858 | 5/1988 |
| JP | 2-87157 | 3/1990 |
| JP | 3-84558 | 4/1991 |
| JP | 4-1766 | 1/1992 |
| JP | 4-102862 | 4/1992 |
| JP | 7-230182 | 8/1995 |
| JP | 8-286421 | 11/1996 |
| JP | 9-26672 | 1/1997 |
| JP | 65163 | 3/1999 |
| JP | 11-149176 | 6/1999 |
| JP | 11/194533 | 7/1999 |
| JP | 11-202557 | 7/1999 |

* cited by examiner

*Primary Examiner*—Christopher Rodee
(74) *Attorney, Agent, or Firm*—Fitzpatrick, Cella, Harper & Scinto

(57) ABSTRACT

A toner showing a high transferability and suitable for use in cleanerless image forming system is formed of toner particles comprising at least a binder resin and magnetic iron oxide. The toner is characterized by a specific circularity distribution relative to its weight-average particle size and a controlled degree of surface-exposed magnetic iron oxide providing an extract solution with hydrochloric acid showing an absorbance of 1.0–2.5 at a wavelength of 340 nm. The toner is suitably produced by a production system including a rotary mechanical pulverizer and a one-pass surface treatment apparatus for continuously applying a mechanical impact force to pulverized toner particles therein.

10 Claims, 14 Drawing Sheets

DRY TONER, TONER PRODUCTION PROCESS, IMAGE FORMING METHOD AND PROCESS CARTRIDGE

FIELD OF THE INVENTION AND RELATED ART

The present invention relates to a toner for use in electrophotography, an image forming method for visualizing an electrostatic image and toner jetting; a process for producing the toner, an image forming method using the toner, and a process cartridge including the toner.

A developing method using an insulating magnetic toner involves an unstable factor associated with the use of such an insulating magnetic toner. More specifically, insulating magnetic toner particles contain a substantial amount of fine powdery magnetic material, and a portion of the magnetic material is isolated from or exposed to the surfaces of the toner particles, thus affecting the flowability and triboelectric chargeability of the magnetic toner to consequently change or deteriorate the various performances, inclusive of developing performance and continuous image forming performances. These difficulties are presumably caused by the presence at the magnetic toner particle surfaces of fine particles of magnetic material having a lower resistivity than the resin constituting the toner. The toner chargeability also greatly affects the developing performance and transferability, thus also deeply affecting the resultant image quality. For this reason, a magnetic toner capable of stably attaining a high charge is seriously demanded.

Further, in recent years, apparatus utilizing electrophotography have been used not only as copying machines for reproducing originals but also for printers for computers and facsimile apparatus. Accordingly, electrophotographic apparatus are id required to be smaller in size and weight and to exhibit higher speed and reliability, so that they are required to be composed of simpler components. Consequently, a toner is required to exhibit higher performances, failure of which makes impossible the realization of an excellent image forming apparatus.

JP-A 7-230182 and JP-A 8-286421 have proposed external addition of magnetic material powder for stabilizing the chargeability. This allows the provision of a toner showing a stable chargeability and high cleanability, but the toner is liable to be attached to a contact charging member which is frequently included in a high-speed printer of a simple structure.

Further, JP-A 11-194533 has proposed a magnetic toner having a specific level of wettability with an alcohol by controlling the state of presence of a magnetic material at the toner particle surfaces, thereby suppressing the attachment onto the charging member and the photosensitive drum. However, a room for improvement has been left regarding the attachment onto the fixing member and also regarding fog in high-speed machines.

Further, after a transfer step of transferring a toner image from a photosensitive member to a transfer(-receiving) material, a portion of toner (transfer residual toner) remains on the photosensitive member without being transferred. The residual toner has to be cleaned from the photosensitive member in order to continuously obtain good toner images in a continuous copying or printing. The recovered residual toner is stored in a vessel in the image forming machine or a recovery box and then discharged as a waste toner or recycled.

In order to obviate the occurrence of waste toner, the image forming apparatus has to be equipped with a recycle mechanism. Such a recycle system to be placed in the apparatus has to be a large-scale one for complying with multiplicity of function, high-speed and high image quality required of copying machines, printers and facsimile apparatus demanded on the market, thus resulting in a larger apparatus which is against the demand for a smaller apparatus in the market. This problem is encountered also in the case of storing the waste toner in a vessel or a recovery box disposed in the apparatus or in a system including a waste toner recovery unit integral with the photosensitive member.

Further, in recent years, demands for color images have been increased, and for providing high-quality color images, a high rate or good efficiency of toner transfer complying with multi-color transfer or superposed toner image transfer, is demanded.

In order to comply with these demands, the rate or efficiency of transfer at the time of transferring a toner image from a photosensitive member to a transfer material has to be increased.

JP-A 9-26672 has proposed a toner containing a transfer efficiency-improving agent having an average particle size of 0.1–3 $\mu$m and hydrophobic silica fine powder having a BET specific surface area of 50–300 $m^2/g$, so that the toner is provided with a reduced volume resistivity and a thin layer of the transfer efficiency-improving agent is formed on the photosensitive member, to increases the transfer efficiency. However, a toner produced through the pulverization process is caused to have a generally broad particle size distribution, so that it is difficult to uniformly increase the transfer efficiency of all the toner particles, thus leaving a room for further improvement.

For improving the transfer efficiency, there has been known a method of forming a toner, of which the shape is made closer to a sphere. Examples thereof may include production methods by spraying toner particle formation, dissolution with a solution and polymerization as disclosed in JP-A 3-84558, JP-A 3-229268, JP-A 4-1766 and JP-A 4-102862. However, these toner production methods require a large production apparatus, and the resultant sphere-like toner particles are liable to cause a problem of cleaning failure because of their spherical shape.

Further, JP-A 2-87157, JP-A 11-149176 and JP-A 11-202557 disclose a method of modifying a particle shape and a surface property of toner particles produced through the pulverization process thermally or by applying a mechanical impact, thereby improving the transfer efficiency. However, the thus-improved transfer efficiency is still insufficient in an image forming system for achieving versatile functions, higher speed, higher image qualities and machine size reduction for image forming machines inclusive of copying machines, printers and facsimile apparatus.

Further, JP-A 11-65163 has disclosed a method of blending toner particles having two types of shapes to control the toner shape factor, thereby achieving a cleanerless system. However, blending of toner particles of different shapes results in a shape distribution, which requires a further improvement for achieving a higher-image quality and smaller-size image forming system.

In a conventional toner production process including a pulverization step, toner ingredients including a binder resin for ensuring toner fixation onto a transfer material, a colorant or magnetic material for providing a toner and a charge control agent for imparting a chargeability to toner particles are dry-blended and melt-kneaded by a kneading apparatus, such as a roll mill or an extruder, and, after being cooled and solidified, the kneaded product is pulverized by a pulverizing apparatus, such as a jet stream-type pulverizer or a mechanical impingement-type pulverizer, followed by classification by means of a pneumatic classifier, to obtain toner particles, which are optionally further blended with a flowability improver and a lubricant externally added thereto. In order to provide a two-component developer, the toner may be blended with a magnetic carrier.

An example of such a process for producing toner particles is illustrated by a flow chart shown in FIG. 7.

A coarsely pulverized material is continuously or successively fed to a first classification means, from which a coarse powder fraction principally comprising particles beyond a prescribed particle size range is sent to a pulverization means for pulverization and then recycled to the first classification means.

The other fine powder fraction principally comprising particles within the prescribed particle size range and particles below the prescribed particle size range is supplied to a second classification means and separated thereby into medium powder principally comprising particles within the prescribed particle size range, fine powder principally comprising particles below the prescribed particle size range and coarse powder principally comprising particles above the prescribed particle size range.

As the pulverization means, various pulverizers are used, and for pulverization of a coarsely pulverized toner product principally comprising a binder resin, an impingement-type pneumatic pulverizer using a jet gas stream as shown in FIG. 8 is generally used.

In such an impingement-type pneumatic pulverizer using a high pressure gas for a jet gas stream, a powdery material is conveyed with a jet air stream and ejected from an outlet of an acceleration pipe to be impinged onto an impingement surface of an impingement member disposed opposite to the outlet opening of the acceleration pipe, whereby the powdery material is pulverized by an impact force caused by the impingement.

For example, in the impingement-type pneumatic pulverizer shown in FIG. 8, an impingement member 164 is disposed opposite to an outlet port 163 of an acceleration pipe 162 connected to a high-pressure gas feed nozzle 161, a powdery material is sucked through a powder material feed port 165 formed intermediate the acceleration tube 162 into the acceleration tube 162 under the action of a high-pressure gas supplied to the acceleration pipe, and the powder material is ejected from the outlet port 163 together with the high-pressure gas to impinge onto the impinging surface 166 of the impingement member 164 to be pulverized under the impact. The pulverized product is discharged out of a discharge port 167.

However, as the powdery material is pulverized by the impacting force caused by the impingement of the powder ejected together with a high-pressure gas onto the impingement member, the resultant toner particles are made indefinitely shaped and angular, and the release agent and magnetic material powder are liable to be isolated from the toner particles.

Further, in order to produce a small particle size toner by using the above-mentioned impingement-type pneumatic pulverizer, a large amount of air is required, thus increasing the electric power consumption which results in an increase in production energy cost. In recent years, economization of toner production energy is also required from an ecological viewpoint.

As for the classification means, various pneumatic classifiers and classifying methods have been proposed, including classifiers using rotating vanes and classifiers having no moving units. The latter includes a fixed wall-type centrifugal classifier, and a classifier utilizing an inertia.

The use of the latter inertia-type classifiers has been proposed in Japanese Patent Publication (JP-B) 54-24745, JP-B 55-6433 and JP-A 63-101858.

According to such a pneumatic classifier, as illustrated in FIG. 9, a powdery material is ejected together with a high-speed gas stream through a supply nozzle opening into a classification zone of a classification chamber, and under the action of a centrifugal force caused by a curved gas stream flowing along a Coanda block 145, the powdery material is classified into coarse powder (158), medium powder (159) and fine powder (160) which are separated by narrow-tipped edges 146 and 147.

More specifically, in such a classification apparatus, a pulverized powder material is introduced through a supply nozzle including tapered rectangular pipe sections 148 and 149, where a powdery material tends to flow straightly and parallel to the tube walls. However, in the supply nozzle, the powder supply stream is liable to be separated into an upper stream rich in light fine powder and a lower stream rich in heavier coarse powder. The respective powder streams are liable to flow separately and be ejected in different courses depending on positions of introduction into the classifying chamber, and further the coarse powder stream is liable to disturb the course of flying of fine powder, thus posing a limit of improved classification accuracy.

Moreover, a large number of different properties are required of a toner, and many of them are determined not only by the starting materials but also by the production processes. The toner classification step is required to provide classified particles having a sharp particle size distribution at a low cost and in a stable manner.

Further, in recent years, toner particles are gradually becoming smaller in size in order to improve the image quality in copying machines and printers in recent years. Generally, a particulate substance is governed by a larger inter-particle force as the particle size becomes smaller. This is also true with toner particles principally comprising a resin, and the agglomeratability thereof becomes larger as the size thereof is smaller.

As a result, in the case of obtaining a toner having a weight-average particle size of at most 10 $\mu$m and a sharp particle size distribution, the classification efficiency is significantly lowered by using conventional apparatus and methods. Particularly in the case of obtaining a toner having a weight-average particle size of at most 8 $\mu$m and a sharp particle size distribution, not only the classification efficiency is significantly lowered, but also the classified toner particles are liable to have a large amount of an ultra-fine powder fraction, by using conventional apparatus and methods.

Further, according to the conventional system, even if a toner product having an accurate particle size distribution can be attained, the steps therein are liable to be complicated to result in a lower classification efficiency, a lower production yield and a higher production cost. This tendency becomes more noticeable if the prescribed size becomes smaller.

Further, in the case of a magnetic toner having a smaller particle size than usual, the amount of colorant, (magnetic material) contained in toner particles is increased in order to suppress the fog, and the amount of colorant (magnetic material) isolated from the toner particle is increased correspondingly. As a result, in order to comply with a higher process speed, the lowering in low-temperature fixability and restriction on developing performance of a magnetic toner become severer than ever.

SUMMARY OF THE INVENTION

A generic object of the present invention is to provide a dry toner having solved the above-mentioned problems.

A more specific object of the present invention is to provide a toner showing a high transfer efficiency and thus resulting in less waste toner.

Another object of the present invention is to provide a toner suitable for providing a cleanerless image forming system.

Further objects of the present invention are to provide a process for producing such a toner, and an image forming method and a process cartridge using such a toner.

According to the present invention, there is provided a toner, comprising: toner particles each comprising at least a binder resin and magnetic iron oxide, wherein the toner has a weight-average particle size X ($\mu$m) of 4–12 $\mu$m;

the toner contains particles of at least 3 $\mu$m which include:

at least 85% by number of particles satisfying a circularity Ci of at least 0.900 according to formula (1) below:

$$Ci=L_0/L \quad (1),$$

wherein L denotes a peripheral length of a projection image of an individual particle, and $L_0$ denotes a peripheral length of a circle giving an identical area as the projection image, and a number-basis percentage Y (%) of particles having a circularity Ci of at least 0.950 according to the formula (1) above satisfying a relationship of formula (2) below with respect to the weight-average particle size X ($\mu$m) of the toner;

$$Y \geqq X^{-0.715} \times \exp 5.31 \quad (2); \text{ and}$$

the toner provides an extract solution showing an absorbance of 1.0–2.5 at a wavelength of 340 nm when the extract solution is obtained by extracting 20 mg of the toner with 5 ml of 3 mol/l-hydrochloric acid for 50 min.

According to the present invention, there is also provided a process for producing the above-mentioned toner comprising:

a step of melt-kneading a mixture comprising at least a binder resin and magnetic iron oxide to provide a melt-kneaded mixture, a step of cooling the melt-kneaded mixture, a pulverizing step of pulverizing the cooled melt-kneaded mixture by a pulverizing means to provide a pulverizate, a step of classifying the pulverizate to provide toner particles, and a surface-treatment step of surface-treating the toner particles to provide a toner;

wherein the pulverizing means includes a mechanical pulverizer comprising a rotor affixed to a central rotation shaft and a stator disposed around and with a prescribed gap from the rotor for pulverizing a powdery feed in the gap, and in the surface-treatment step, the toner particles are surface-treated by passing the toner particles through a surface treatment apparatus for continuously applying a mechanical impact force to the toner particles.

The present invention also provides an image forming method, comprising:

a latent-image forming step of forming an electrostatic image on an image-bearing member; a developing step of developing the electrostatic image on the image-bearing member with the above-mentioned toner to form a toner image on the image-bearing member; a transfer step of transferring the toner image from the image-bearing member onto a secondary medium via or without via an intermediate transfer member; and a fixing step of fixing the toner image onto the recording medium;

wherein the developing step also functions as a step of recovering transfer residual toner remaining on the image-bearing member after transfer of the toner image from the image-bearing member in addition to formation of the toner image on the image-bearing member.

The present invention further provides a process cartridge, detachably mountable to an image forming apparatus and comprising integrally at least an image-bearing member and a developing means for developing an electrostatic image on the image-bearing member with the above-mentioned toner to form a toner image on the image-bearing member, wherein the developing means also functions as a means for recovering transfer residual toner remaining on the image-bearing member after transfer of the toner image from the image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
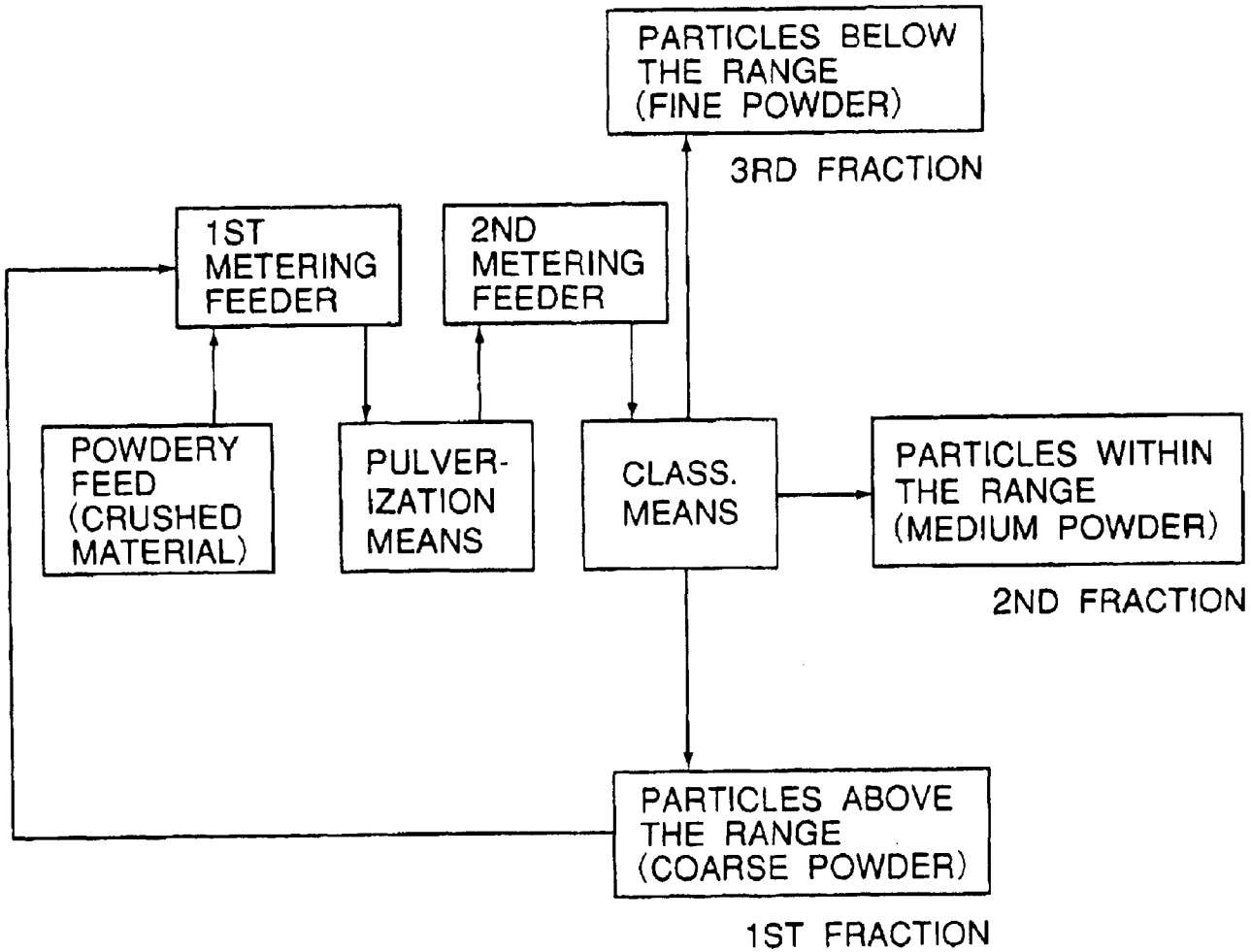
FIG. 1 is a flow chart for illustrating an example of toner production process according to the invention.

As a result of our study on the toner particle shape and the amount of magnetic iron oxide at the toner particle surfaces, produced by the pulverization process, it has been found that the shape of toner particles of at least 3 μm and the amount of magnetic iron oxide present at the toner particle surfaces are closely related with the transferability, developing performance and particularly the quick chargeability of the toner, and by controlling these factors, even a toner produced through the pulverization process allows a cleanerless image forming method. Further, it has been also found possible to produce such a toner optimally through a process including pulverization, classification and surface treatment system.

More specifically, we have found that a toner comprising at least a binder resin and magnetic iron oxide, providing an extract solution (obtained when 20 mg thereof is extracted for 50 min. with 5 ml of 3 mol/l-hydrochloric acid) showing an absorbance of 1.3–2.3 at a wavelength of 340 nm and showing a specific circularity distribution, can exhibit an improved transferability without impairing fixability and stable image quality in high and low humidity environments, thus not causing image defects in continuous image formation.

When a toner is added to and left immersed in 3 mol/l-hydrochloric acid, hydrochloric acid-soluble components at and in proximity to the toner particle surfaces are extracted in the hydrochloric acid. In a magnetic toner containing magnetic iron oxide, the extractable component is principally the magnetic iron oxide. If the charge control agent and the colorant additionally contained in the toner are soluble in hydrochloric acid, these components can also be extracted, but these components are usually contained in much smaller amount than magnetic iron oxide, so that most of the extractable component is originated from the magnetic iron oxide.

Further, in the present invention, the absorbance of the component extracted with hydrochloric acid is measured at a wavelength of 340 nm, where the absorbance with iron is principally caused. Thus, the absorbance of the extract solution formed by extraction for 50 min. of a toner with 3 mol/l-hydrochloric acid is attributable to magnetic iron oxide present at or in proximity to the toner particle surfaces, and based on the absorbance value, the proportion of magnetic iron oxide in proximity to the toner particle surface can be estimated.

An absorbance at a wavelength of 340 nm larger than 2.5 means the exposure of large amount of magnetic iron oxide at toner particle surfaces, and the exposed magnetic iron oxide is liable to drop off the toner particles to obstruct the cleaning performance of a cleaning member for toner cleaning. As a result, the toner is liable to attach to the charging member in a low temperature/low humidity environment, and is liable to be pressed by the charging member and attached onto the photosensitive drum surface in a high temperature/high humidity environment. The toner attached to the charging member and the photosensitive drum surface makes unstable the charge control, thus being liable to adversely affect the developing performances. Further, the toner charge is liable to be leaked via the exposed magnetic iron oxide, to result in a lower toner charge. A toner having such a lower charge results in increased fog and a lower transferability which further promotes the charging failure, thus adversely affecting the developing performances. Further, in such a toner, the dispersion of magnetic iron oxide in the toner particles is ununiform, thus resulting in an ununiform chargeability which beads to a problem in image density increase at an initial stage of image formation in low temperature/low humidity environment.

On the other hand, an absorbance of below 1.0 at a wavelength of 340 nm attributable to magnetic iron oxide means little exposure of magnetic iron oxide at the toner particle surfaces. Such a toner containing little surface-exposed magnetic iron oxide exhibits a high chargeability but is liable to be excessively charged in continuous image formation on a large number of sheets by a high-speed machine, particularly in a low temperature/low humidity environment, thus causing a lowering in image density. Such a toner is also liable to form a denser toner layer to result in lower image qualities, such as a lower dot reproducibility, trailing of images and thickening of line widths.

Thus, by controlling the absorbance at a wavelength of 340 nm of an extract solution obtained by extracting 20 mg of a toner for 50 min. with 3 mol/l-hydrochloric acid, it becomes possible to provide a toner with suppressed toner attachment onto the charging member or the photosensitive drum and also with easy charge controllability so as to provide a toner with excellent charge uniformity and stability in continuous image formation.

More specifically, the absorbance at a wavelength of 340 nm as a measure of amount of magnetic iron oxide present at the toner particle surfaces described herein is based on values measured in the following manner.

<Absorbance at 340 nm (Magnetic Iron Oxide at Toner Surfaces>

1) A sample toner is accurately weighed at 20 mg.

2) The sample toner is placed in a sample bottle and 5 ml of 3 mol-hydrochloric acid is added thereto, and the mixture is left to stand for 50 min. in a normal temperature/normal humidity environment (of 23.5° C./60% RH).

3) The solution after the standing is filtered through a sample treatment filter (having a pore size of 0.2–0.5 μm; e.g., "MAISHORI DISC H-25-2", made by Toso K.K.).

4) The filtrate liquid is placed in a sample cell in parallel with a reference cell containing 3 mol/l-hydrochloric acid not containing any toner component. Intensities of light having a wavelength of 340 nm and transmitted through the sample cell and the reference cell are measured by a spectrophotometer ("UV-3100PC", made by Shimadzu Seisakusho K.K.) under the following conditions:

| | |
|---|---|
| Scanning speed: | medium in a range of 600–250 nm. |
| Slit width: | 0.5 mm. |
| Sampling pitch: | 2 nm. |

From the measured transmitted light intensities I and $I_0$ through the sample cell and the reference cell respectively, the absorbance at 340 nm is calculated according to the following formula:

$$\text{Absorbance}=\log(I_0/I),$$

wherein "log" represents a common logarithm.

In the present invention, a circularity (Ci) is used as a convenient parameter for quantitatively indicating a particle shape based on values measured by using a flow-type particle image analyzer ("FPIA-2100", available from Sysmex K.K.). For each measured particle, a circularity Ci is calculated according to equation (1) below, and an average circularity Cav. is calculated by dividing the total of circularities (Ci) of all the measured particles with the number (m) of the measured particles as shown in equation (7) below.

$$\text{Circularity } Ci = L_0/L \quad (1)$$

wherein L represents a peripheral length of a projection image (two-dimensional image) of an individual particle as measured at an image processing resolution of 512×512 pixels (each having a pixel size of 0.3 μm×0.3 μm), and $L_0$ represents a peripheral length of a circle giving an identical area as the projection image.

$$\text{Average circularity } Cav = \sum_{i=1}^{m} Ci/m \quad (1A)$$

wherein m represents a number of measured particles.

As is understood from the above equation (1), a circularity Ci is an index showing a degree of unevenness of a particle, and a perfectly spherical particle gives a value of 1.00, and a particle having a more complicated shape gives a smaller value.

In the flow-type particle image analyzer ("FPIA-2100") used herein, for convenience of calculation, an actual calculation is automatically performed according to the following scheme: that is, circularities (Ci) of individual particles are classified into 61 divisions by an increment of 0.010 within a circularity range of 0.400–1.000, i.e., 0.400–below 0.410, 0.410–below 0.420, . . . 0.990–below 1.000, and 1.000. Then, an average circularity Cav is determined based on central values and frequencies of the respective divisions. However, an error introduced by the convenient calculation is very small and substantially negligible from the value obtained by strictly applying above-mentioned equations.

For an actual measurement of circularity by using the FPIA-measurement, 0.1–0.5 ml of a surfactant (preferably an alkylbenzenesulfonic acid salt) as a dispersion aid is added to 100 to 150 ml of water from which impurities have been removed, and ca. 0.1–0.5 g of sample particles are added thereto. The resultant mixture is subjected to dispersion with ultrasonic waves (50 kHz, 120 W) for 1–3 min. to obtain a dispersion liquid containing 12,000–20,000 particles/μl, and the dispersion liquid is subjected to measurement of a circularity distribution with respect to particles having a circle-equivalent diameter ($D_{CE}$) in the range of 0.60 μm to below 159.21 μm by means of the above-mentioned flow-type particle image analyzer.

The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area (an equivalent circle) is determined as a circle-equivalent diameter ($D_{CE}=L_0/\pi$. Further, for each particle, a peripheral length ($L_0$) of the equivalent circle is determined and divided by a peripheral length (L) measured on the two-dimensional image of the particle to determine a circularity Ci of the particle according to the above-mentioned formula (1).

The circularity measurement apparatus ("FPIA-2100") used herein allows a better accuracy of circularity measurement than a conventional circularity measurement apparatus ("FPIA-1000") by modifications including (i) use of a smaller sample flow thickness and (ii) a higher image processing resolution of 512×512 pixels (each measuring 0.3 μm×0.3 μm) in a visual field of ca. 150 μm×150 μm compared with 256×256 pixels in an identical visual field of ca. 150 μm×150 μm (of "FPIA-1000"). As a result of the comparison, it has been confirmed that the measurement by "FPIA-1000" tends to provide a higher circularity level due to inability of accurately capturing contours of relatively small particles.

Hitherto, it has been known that a toner shape affects various toner performances. As a result of our study, it has been found that the shape of toner particles of 3 μm or larger and the amount of magnetic iron oxide exposed to the toner particle surfaces remarkably affect the transferability and developing performances of the toner, and by controlling these factors, it is possible to realize a cleaner-less image forming method (or a simultaneous developing-and-cleaning method). In the cleaner-less image forming method, it is critical to control the polarity and amount of charge of transfer residual toner particles remaining on the photosensitive member and stably recover the transfer residual toner particles in the developing step while obviating the adverse effects of the recovered toner on the developing performances. This is well accomplished by using the toner of the present invention.

More specifically, the toner of the present invention contains particles of at least 3 μm which include:

at least 85% by number of particles satisfying a circularity Ci of at least 0.900 according to formula (1) below:

$$Ci = L_0/L \quad (1),$$

wherein L denotes a peripheral length of a projection image of an individual particle, and $L_0$ denotes a peripheral length of a circle giving an identical area as the projection image, and a number-basis percentage Y (%) of particles having a circularity Ci of at least 0.950 according to the formula (1) above satisfying a relationship of formula (2) below with respect to the weight-average particle size X (μm) of the toner;

$$Y \geqq X^{-0.715} \times \exp 5.3 \quad (2).$$

If the toner satisfies the above-mentioned circularity requirements, the toner allows easy charge control and can realize uniform and stable chargeability in a continuous image formation, so that the transfer-residual toner recovered from the photosensitive member can acquire a stable charge and the charge thereof for re-utilization in development can be well controlled. Further, in such a toner satisfying the above-mentioned circularity requirement, the toner particles are caused to have a smaller contact area with the photosensitive member, thus resulting in a smaller force of attachment attributable to van der Waals force onto the photosensitive member. Further, as the toner particles have a smaller surface area compared with conventional toner particles obtained through pulverization, the toner particles can be packed in a higher bulk density due to a reduced contact area between toner particles, thus showing a better heat conduction and the time of fixation to result in an improved fixing performance.

If the number-basis percentage of particles having Ci≧0.900 is below 85% within the particles of 3 μm or larger, the contact area of the toner particles with the developer-carrying member, the photosensitive member, etc., is increased, so that the toner charge is liable to be leaked through the contact portions to result in a lower toner charge. Further, because of an increased contact area with the photosensitive member, the attachment force of the toner particles onto the photosensitive member is increased to result in a difficulty in obtaining a sufficient transferability.

Further, if the number-basis percentage Y (%) of particles having Ci≧0.950 within particles of 3 μm or larger fails to satisfy the above-mentioned relationship according to the formula (2), i.e., caused to fall in a case of $Y<\exp 5.31\times X^{-0.715}$ with respect to a weight-average particle size X (=D4) of the toner, the toner is liable to have a lower flowability, thus a lower transferability, and also a lower fixing performance.

The toner having the above-mentioned circularity requirement should also satisfy a weight-average particle size (D4=X) of 4–12 μm. It is further preferred that the toner shows D4=5–10 μm, and contains at most 40% by number of particles of at least 4.0 μm in particle size and at most 25% by volume of particles of at least 10.1 μm in particle size.

A toner having D4>12 μm is liable to comprise angular toner particles, so that it becomes difficult to attain desired circularity level and circularity distribution.

A toner having D4<4 μm is liable to have a too spherical particle shape or excessive coverage of magnetic iron oxide at the surface due to excessive heat-supply, so that it becomes difficult to satisfy both the circularity distribution and the superficial amount of the magnetic iron oxide, and it becomes difficult to suppress the occurrence of fine powder and ultra-fine powder.

Similarly, a toner containing more than 40% by number of particles having particle sizes of at most 4.0 μm is liable to have a too spherical particle shape or excessive coverage of magnetic iron oxide at the surface due to excessive heat supply, so that it becomes difficult to satisfy both the circularity distribution and the amount of magnetic iron oxide at the surface.

A toner containing more than 25% by volume of particles having particle sizes of at least 10.1 μm is liable to comprise angular toner particles, so that it becomes difficult to attain the desired circularity level and distribution.

As a measure of fluctuation in circularity of particles, a circularity standard deviation SDc defined according to the following formula may also be relied on. The toner of the present invention may well have a value of SDc within a range of 0.030 to 0.065.

$$SDc = \left(\sum_{i=1}^{m} (Cav.-Ci)^2/m\right)^{1/2}.$$

Next, some description will be made regarding the composition of the toner according to the present invention.

The binder resin constituting the toner may preferably have an acid value of 1–100 mgKOH/g, more preferably 1–50 mgKOH/g, further preferably 2–40 mgKOH/g.

If the binder resin does not have an acid value in the above-described range, the dispersion of toner ingredients, particularly magnetic iron oxide particles, within the binder resin in the step of melt-kneading is liable to be inferior, so that it becomes difficult to control the degree of exposure of magnetic iron oxide at the toner particle surfaces during the pulverization and surface-treatment steps. Further, if the acid value of the binder resin is below 1 mgKOH/g, the resultant toner particles are liable to have a lower chargeability, thus providing a toner with lower developing performance and stability in continuous image formation. On the other hand, above 100 mgKOH/g, the binder is liable to be excessively moisture-absorptive, to provide a toner resulting in a lower image density and increased fog.

The acid values of the binder resin described herein are based on values measured according to the following method.

<Acid Value Measurement>

The basic operation is according to JIS K-0070.

1) A binder resin is pulverized, and 0.5–2.0 g of the pulverized sample is accurately weighed to provide a sample containing W (g) of binder resin.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value is calculated according to the following equation:

$$\text{Acid value (mgKOH/g)}=\{(S-B)\times f\times 5.61\}/W,$$

wherein f denotes a factor of the 0.1 mol/liter-KOH solution.

The binder resin for constituting the toner of the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

In view of the storage stability of the toner, the binder resin may preferably have a glass-transition temperature (Tg) of 45–75° C., further preferably 50–70° C. If Tg is below 45° C., the toner is liable to be deteriorated in a high temperature environment and cause offset in the fixing step. On the other hand, if Tg exceeds 75° C., the fixability is liable to be lowered.

In the toner of the present invention, fine particles of a magnetic iron oxide such as magnetite, maghemite or ferrite are used as a magnetic materials, and may preferably contain a non-iron element at the surfaces or inside thereof.

It is particularly preferred to use a magnetic iron oxide containing at least one element selected from lithium, beryllium, boron, magnesium, aluminum, silicon, phosphorus, germanium, titanium, zirconium, tin, lead, zinc, calcium, barium, scandium, vanadium, chromium, manganese, cobalt, copper, nickel, gallium, indium, silver, palladium, gold, mercury, platinum, tungsten, molybdenum, niobium, osmium, strontium, yttrium, technetium, ruthenium, rhodium, and bismuth. The non-iron element may particularly preferably be selected from lithium, beryllium, boron, magnesium, aluminum, silicon, phosphorus, germanium, zirconium and tin. These elements can be captured in the iron oxide crystal lattice or may be incorporated in the form of oxide in the magnetic iron oxide, or may be present as an oxide or hydroxide at magnetic iron oxide particle surfaces. In a preferred form, such a non-iron element is contained in the form of an oxide.

The magnetic iron oxide may preferably be contained in 20–200 wt. parts, particularly preferably 40–150 wt. parts, per 100 wt. parts of the binder resin.

Arbitrary pigments or dyes may be added as another colorant to the toner of the present invention. Examples of the pigment may include: carbon black, aniline black, acetylene black, Naphthol Yellow, Hansa Yellow, Rohdamine Lake, Alizarin Lake, red iron oxide, Phthalocyanine Blue and Indanthrene Blue. The pigment may be used in an amount for providing a sufficient optical density, of e.g., 0.1–20 wt. parts, preferably 1–10 wt. parts, per 100 wt. parts of the binder resin. For a similar purpose, a dye can be used. Examples thereof may include: azo dyes, anthraquinone dyes, xanthene dyes and methine dyes. The dye may be used in 0.1–20 wt. parts, preferably 0.3–10 wt. parts, per 100 wt. parts of the binder resin.

Examples of the waxes usable in the present invention may include: aliphatic hydrocarbon waxes, such as low-molecular weight polyethylene, low-molecular weight polypropylene, polyolefin copolymers, polyolefin wax, microcrystalline wax, paraffin wax, and Fischer-Tropsche wax oxides of aliphatic hydrocarbon waxes, such as oxidized polyethylene wax, and block copolymers of these; waxes principally comprising aliphatic acid esters, such as montaic acid ester wax and castor wax; vegetable waxes, such as candelilla wax, carnauba wax and wood wax; animal waxes, such as bees wax, lanolin and whale wax; mineral waxes, such as ozocerite, ceresine, and petroractum; partially or wholly de-acidified aliphatic acid esters, such as deacidified carnauba wax. Further examples may include: saturated linear aliphatic acids, such as palmitic acid, stearic acid and montaic acid and long-chain alkylcarboxylic acids having longer chain alkyl groups; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol and long-chain alkyl alcohols having longer chain alkyl groups; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat.

Examples of preferably usable waxes may include: polyolefins obtained by radical polymerization of olefins under high pressure; polyolefins obtained by purification of low-molecular weight by-products obtained in polymerization for high-molecular weight polyolefins; polyolefins polymerized under low pressure by using catalysts such as a Ziegler catalyst or a metallocene catalyst; polyolefins polymerized under irradiation with radiation, electromagnetic wave or light; low-molecular weight polyolefin by thermal decomposition of high-molecular weight polyolefin; paraffin wax, microcrystalline wax, Fischer-Tropsche wax; synthetic hydrocarbon waxes, such as those synthesized through the Synthol process, the Hydrocol process and the Arge process; synthetic wax obtained from mono-carbon compound; hydrocarbon waxes having a functional group, such as a hydroxyl group or carboxyl group; mixtures of hydrocarbon waxes and functional group-containing waxes; and waxes obtained by grafting onto these waxes with vinyl monomers, such as styrene, maleic acid esters, acrylates, methacrylates and maleic anhydride.

It is also preferred to use a wax having a narrower molecular weight distribution or a reduced amount of impurities, such as low-molecular weight solid aliphatic acid, low-molecular weight solid alcohol, or low-molecular weight solid compound, by the press sweating method, the solvent method, recrystallization, vacuum distillation, supercritical gas extraction or fractionating crystallization.

In order to provide the toner with a good balance of fixability and anti-offset property, it is preferred to use a wax having a melting point of 65–160° C., more preferably 65–130° C., further preferably 70–120° C. Below 65° C., the anti-blocking property of the toner is lowered, and above 160° C., it is difficult to attain the anti-offset effect.

In the toner of the present invention, the wax may be used in an amount of 0.2–20 wt. parts, more preferably 0.5–10 wt. parts, per 100 wt. parts of the binder resin. It is possible to use such waxes singly or in combination of two or more species in a total amount within the above range.

The wax melting point is determined in terms of a peak-top temperature of a largest peak on a heat-absorption curve of a wax according to DSC (differential scanning calorimetry).

For a DSC measurement of a wax or a toner, it is possible to use, a high-accuracy internal heat input compensation-type differential scanning calorimeter, e.g., "DSC-7" (available from Perkin-Elmer Corp.), according to ASTM D3418-82. It is appropriate to once heat a sample for removing a thermal history and then heat the sample at rate of 10° C./min in a temperature range of 0–200° C. to take a DSC heat-absorption curve.

The toner of the present invention may preferably contain a charge control agent.

Examples of negative charge control agents may include: monoazo dye metal complexes as disclosed in JP-B 41-20153, JP-B 42-27596, JP-B 44-6397 and JP-B 45-26478; nitrohumic acid, its salt and dye or pigment, such as C.I. 14645 disclosed in JP-A 50-133838, complexes of salicylic acid, naphthoic acid and dicarboxylic acids with metals, such as Zn, Al, Co, Cr, Fe and Zr disclosed in JP-B 55-42752, JP-B 58-41508, JP-B 58-7384, and JP-B 59-7385; sulfonated copper phthalocyanine pigments; styrene oligomers having introduced nitro or halogen group; and chlorinated paraffins. Because of excellent dispersibility, stable image density and effect of fog reduction, it is preferred to use an azo metal complex of formula (I) below or a basic organic acid metal complex of formula (II) below:

(I)

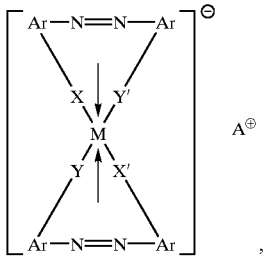

wherein M denotes a coordination center metal selected from the group consisting of Cr, Co, Ni, Mn, Fe, Ti and Al; Ar denotes an aryl group, such as phenyl or naphthyl, each capable of having a substituent, selected from: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes a hydrogen, sodium, potassium, ammonium or aliphatic ammonium ion or a mixture of such ions.

(II)

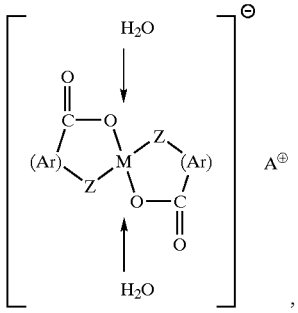

wherein M denotes a coordination center metal selected from the group consisting of Cr, Co, Ni, Mn, Fe, Ti, Zr, Zn, Si, B and Al; Ar denotes an aryl group, example of which may include:

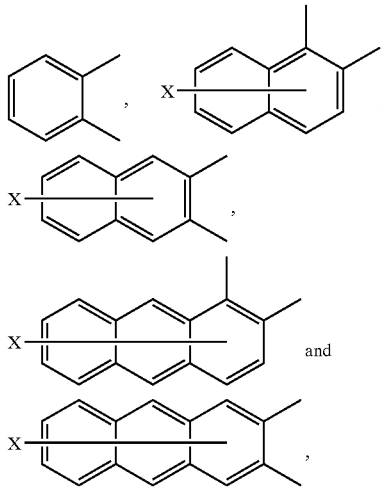

(wherein X denotes hydrogen halogen or nitro).

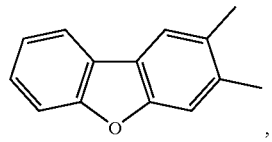

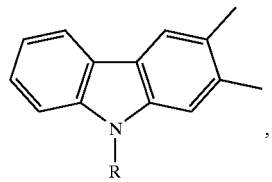

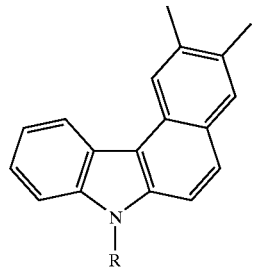

(R denotes hydrogen, $C_1$ to $C_{18}$ alkyl or $C_2$ to $C_{18}$ alkenyl). Each aryl group can have a substituent selected from nitro, halogen, carboxyl, anilide and alkyls and alkoxyles having 1–18 carbon atoms; Z denotes —O— or —CO—O—; and $A^{\oplus}$ denotes a hydrogen, sodium potassium, ammonium or aliphatic ammonium ion, or a mixture of such ions.

Among the above, it is particularly preferred to use an azo metal iron complex of the above formula (I), and particularly an azo iron complex of formula (III) or (IV) shown below.

Formula (III):

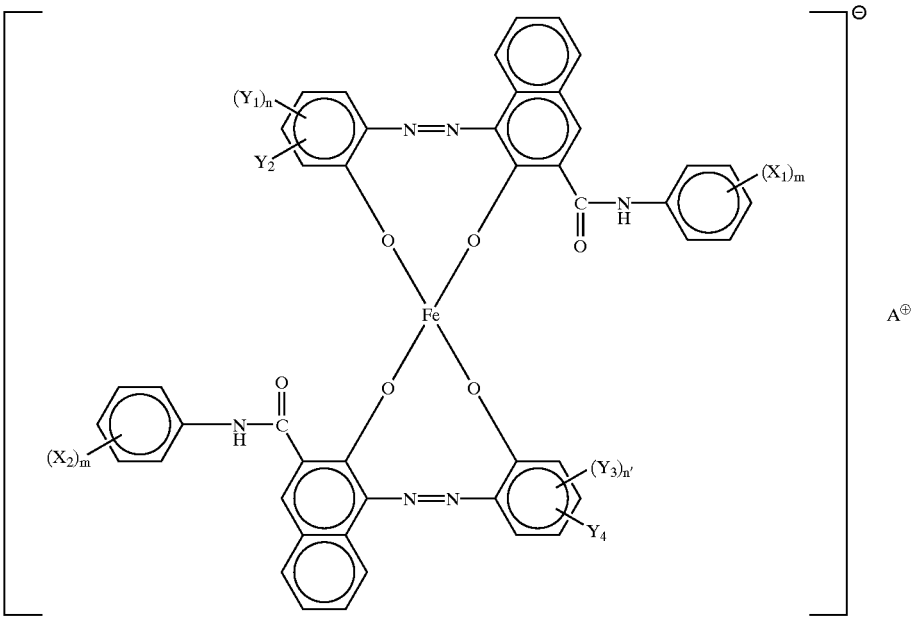

wherein $X_1$ and $X_2$ independently denote hydrogen, alkyl having 1–18 carbon atoms, alkoxy having 1–18 carbon atoms, nitro or halogen; m and m' denote an integer of 1–3; $Y_1$ and $Y_3$ independently denote hydrogen, alkyl having 1–18 carbon atoms, alkenyl having 2–18 carbon atoms, sulfonamide, mesyl, sulfonic acid, carboxy ester, hydroxy, alkoxy having 1–18 carbon atoms, acetylamino, benzoylamino or halogen; n and n' denote an integer of 1–3; $Y_2$ and $Y_4$ independently denote hydrogen or nitro; and $A^{\oplus}$ denotes an ammonium, hydrogen, sodium or potassium ion, or a mixture such ions, preferably containing 75–98 mol % of ammonium ion.

Formula (IV):

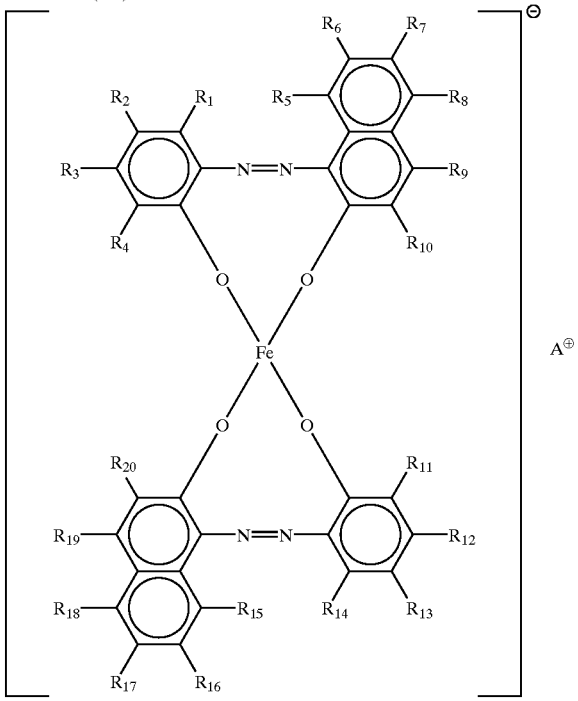

wherein $R_1$–$R_{20}$ independently denote hydrogen, halogen or alkyl; and $A^{\oplus}$ denotes an ammonium, hydrogen, sodium, or potassium ion, or a mixture of such ions.

Specific examples of the azo iron compounds represented by the above formula (III) are enumerated below where $A^{\oplus}$ has the same meaning as defined in the formula (III).

Azo ion complex (1)

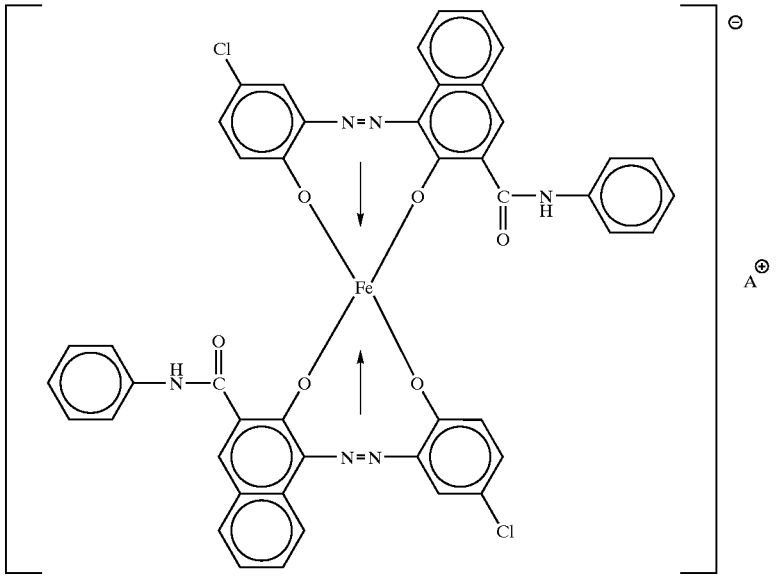

Azo ion complex (2)

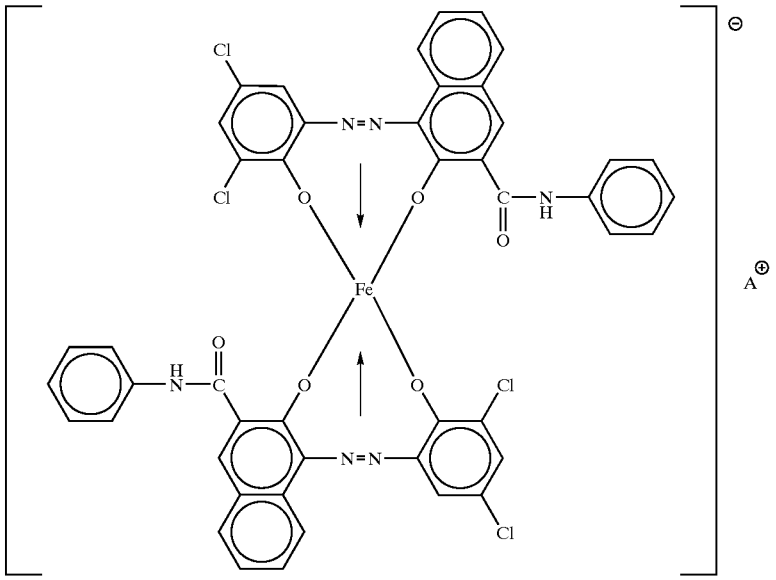

-continued
Azo ion complex (3)
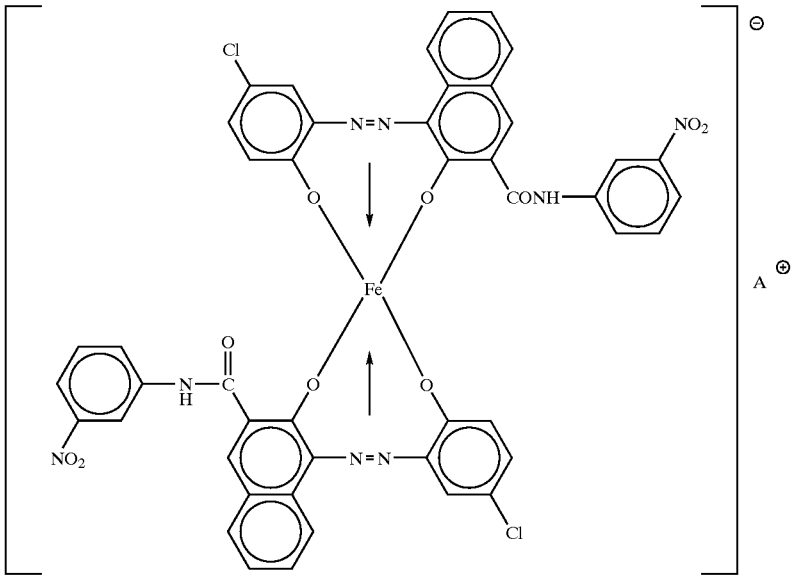
Azo ion complex (4)
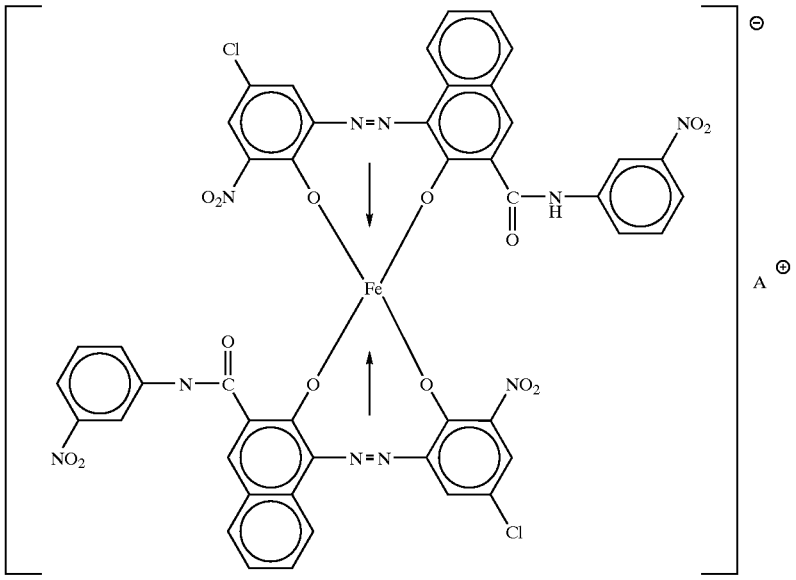

-continued
Azo ion complex (5)
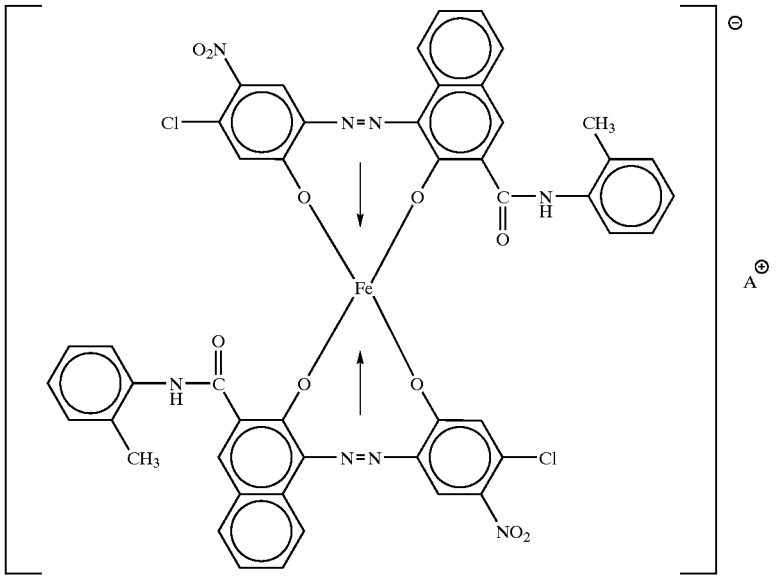
Azo ion complex (6)
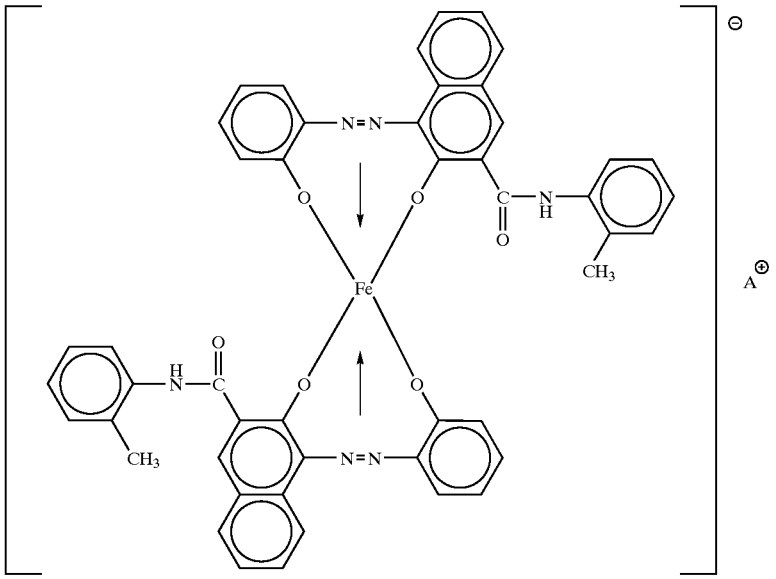
Further, some specific examples of charge control agents represented by the above-mentioned formulae (I), (II) and (IV) are enumerated below where $A^{\oplus}$ has the same meaning as defined in the formula (IV):

Azo chromium xomplex (7):
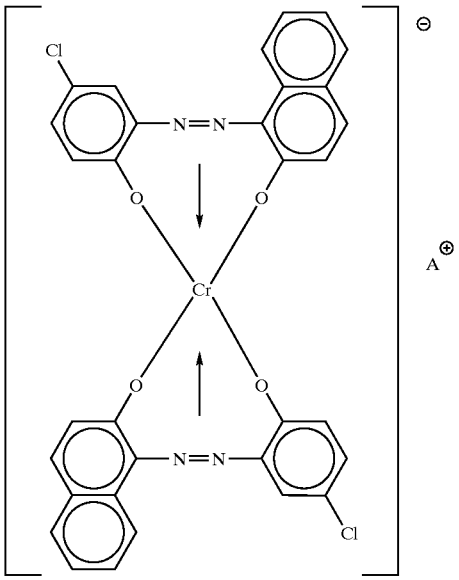
Azo chromium xomplex (8):
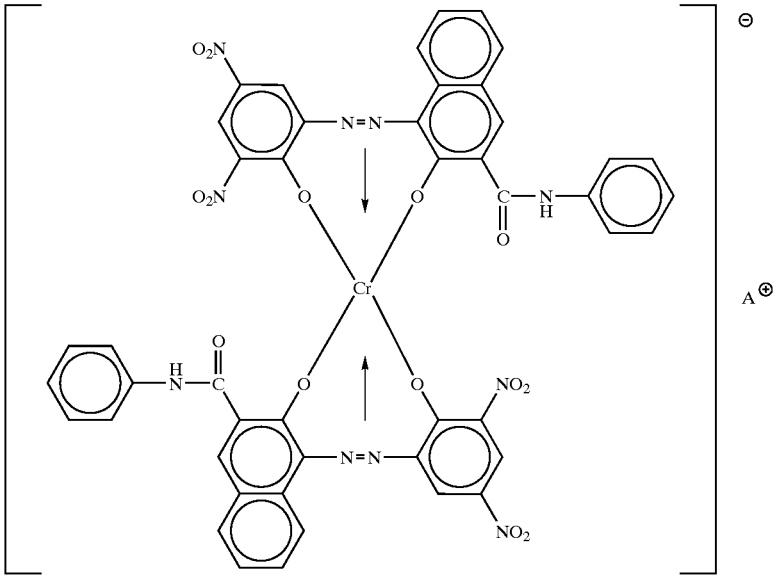
Aluminum complex (9):
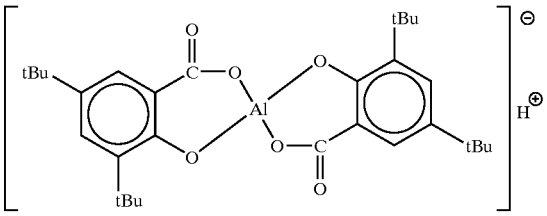
Zinc complex (10):
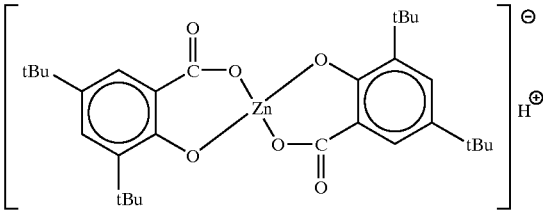

-continued

Chromium complex (11):

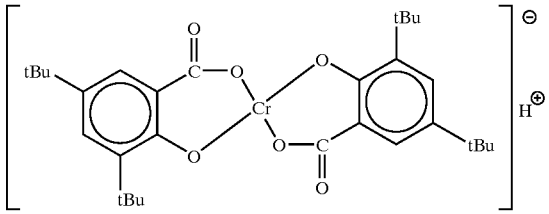

Zicronium complex (12):

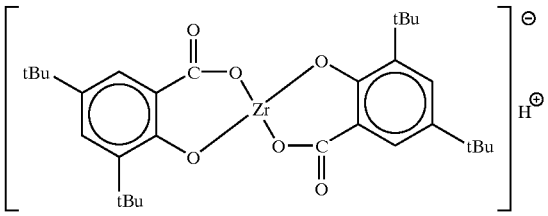

Azo iron complex (13):

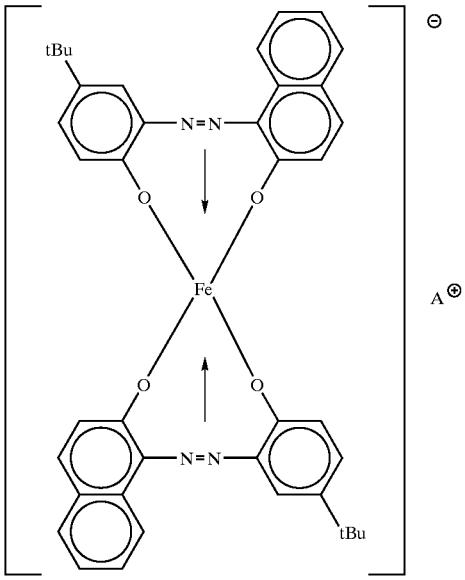

The above-mentioned metal complex compounds may be used singly or in combination of two or more species.

The charge control agent may preferably be used in a proportion of 0.1–5.0 wt. parts per 100 wt. parts of the binder resin.

On the other hand, examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologues inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide. dioctyltin oxide and dicyclohexyltin oxide; and diorganotin borates, such as dibutyltin borate, dioctyltin borate and dicyclohexyltin borate. These may be used singly or in mixture of two or more species.

The toner may preferably contain inorganic fine powder or hydrophobic inorganic fine powder externally added to and blended with toner particles. For example, it is preferred to contain silica fine powder.

As the silica fine powder, it is possible to use both the dry-process silica (or fumed silica) formed by vapor phase oxidation of a silicon halide and the wet-process silica formed from water glass. It is however preferred to use the dry-process silica in view of less superficial or internal silanol groups and less production residue.

It is preferred that the silica fine powder has been hydrophobized. The hydrophobization may be effected by surface treatment of silica fine powder with an organic silicon compound reactive with or physically adsorbed by the silica fine powder. In a preferred embodiment, dry-process silica fine powder formed by vapor-phase oxidation of a silicon halide may be surface-treated with a silane coupling agent, followed by or simultaneously with treatment with an organic silicon compound, such as silicone oil.

Example of such a silane coupling agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

Silicone oil preferably used as an organic silicon compound may have a viscosity at 25° C. of $3\times10^{-5-1\times10-3}$ $m^2/s$. Particularly preferred examples thereof may include: dimethylsilicone oil, methyl-phenylsilicone oil, α-methylstyrene-modified silicone oil, chlorophenylsilicone oil, and fluorine-containing silicone oil.

Treatment with such a silicone oil may be performed by, e.g., direct blending with silicone oil of silica fine powder already treated with a silane coupling agent in a blender, such as a Henschel mixer; spraying silicone oil onto base silica fine powder; or blending of silica fine powder with silicone oil dissolved or dispersed in an appropriate solvent, followed by removal of the solvent.

For use in a cleaner-less image forming method, the toner of the present invention may preferably contain 5–300 particles of electroconductive fine powder having particle sizes of 0.6–3.0 $\mu$m per 100 toner particles. Such electroconductive fine powder having particle sizes of 0.6–3.0 $\mu$m can easily move in isolation from the toner particles and are uniformly attached to and stably retained by the charging member. Accordingly, if 5–300 particles per 100 toner particles of such electroconductive powder are contained in the toner, the chargeability of the toner can be uniformized in the developing step and the transfer step. Further, the recoverability of transfer residual toner particles in the developing and cleaning step can be further stabilized.

Examples of such electroconductive fine powder may include: carbonaceous fine powder, such as carbon black or graphite fine powder; fine powder of metals, such as copper, gold, silver, aluminum and nickel; fine powder of metal oxides, such as zinc oxide, titanium oxide, tin oxide, aluminum oxide, indium oxide, silicon oxide, magnesium oxide, barium oxide, molybdenum oxide, iron oxide and tungsten oxide; fine powder of metal compounds, such as molybdenum sulfide, cadmium, sulfide, and potassium titanate; and agglomerates of primary particles of such electroconductive substances having a number-average primary particle size of 50–500 nm. It is also preferred to use such electroconductive fine powder after adjustment of particle size distribution so as to provide a toner with appropriate particle size and distribution thereof.

The toner of the present invention may contain an external additive, as desired, other than the above. Examples thereof may include: a chargeability-enhancing agent, an electroconductivity-imparting agent, a flowability-improving agent, an anti-caking agent, a release agent for hot roller fixation, and resinous fine particles or inorganic fine particles functioning as a lubricant or abrasive agent.

For example, it is sometimes effective to add a lubricant, such as particles of polytetrafluoroethylene, zinc stearate or polyvinylidene fluoride, preferably polyvinylidene fluoride; an abrasive, such as particles of cerium oxide, silicon carbide or strontium titanate, preferably strontium titanate; a flowability improving agent, such as particles of titanium oxide or aluminum oxide, preferably hydrophobized; an anti-caking agent in electro-conductivity-imparting agent, such as carbon black zinc oxide for tin oxide; and a small amount of white or black fine particles having an opposite polarity of triboelectric chargeability compared with toner particles.

The external additive may preferably be added in 0.1–5 wt. parts, more preferably 0.1–3 wt. parts to 100 wt. parts of the toner.

Now, a preferred embodiment of process for producing the toner of the present invention will be described. FIG. 1 is a flow chart for illustrating an outline of such a production process embodiment. As shown in the flow chart, the toner production process of the present invention is characterized in that it does not include a classification step before the pulverization but includes a single path of pulverization step and classification step.

In the toner production process of the present invention, the degree of exposure at the toner particle surfaces of magnetic iron oxide is controlled to some extent by producing toner particles satisfying specific circularity requirements. Generally, toner ingredients including at least a binder resin, magnetic iron oxide and a wax are melt-kneaded, and the melt-kneaded product after being cooled is pulverized to provide a coarsely pulverized material as a powdery feed. A prescribed amount of the pulverized material is introduced into a mechanical pulverizer including at least a rotor comprising a rotating member affixed to a central rotation shaft, and a stator housing the rotor with a prescribed spacing from the rotor surface, so that an annular space given by the spacing is made airtight, and the rotor is rotated at a high speed to finely pulverize the coarsely pulverized material. Then, the fine pulverizate is introduced to a classification step to obtain toner particles comprising a mass of particles having preferred particle sizes. In the classification step, it is preferred to use a multi-division pneumatic classifier including at least three zones for recovery of fine powder, medium powder and coarse powder. For example, in the case of using a three-division pneumatic classifier, the feed powder is classified into three types of fine powder, medium powder and coarse powder. In the classification step using such a classifier, medium powder is recovered while removing the coarse powder comprising particles having sizes larger than the prescribed range and the fine powder comprising particles having sizes smaller than the prescribed range, and the medium powder is caused to pass through a surface treatment apparatus for continuously applying a mechanical impact force to the medium powder to provide toner particles which may be used as they are as a toner product or blended with an external additive, such as hydrophobic colloidal silica to provide a toner.

The fine powder removed in the classification step and comprising particles having particle size below the prescribed range are generally recycled for re-utilization to the melt-kneading step for providing a coarsely pulverized melt-kneaded product comprising toner ingredients, or discarded.

Figure 2:
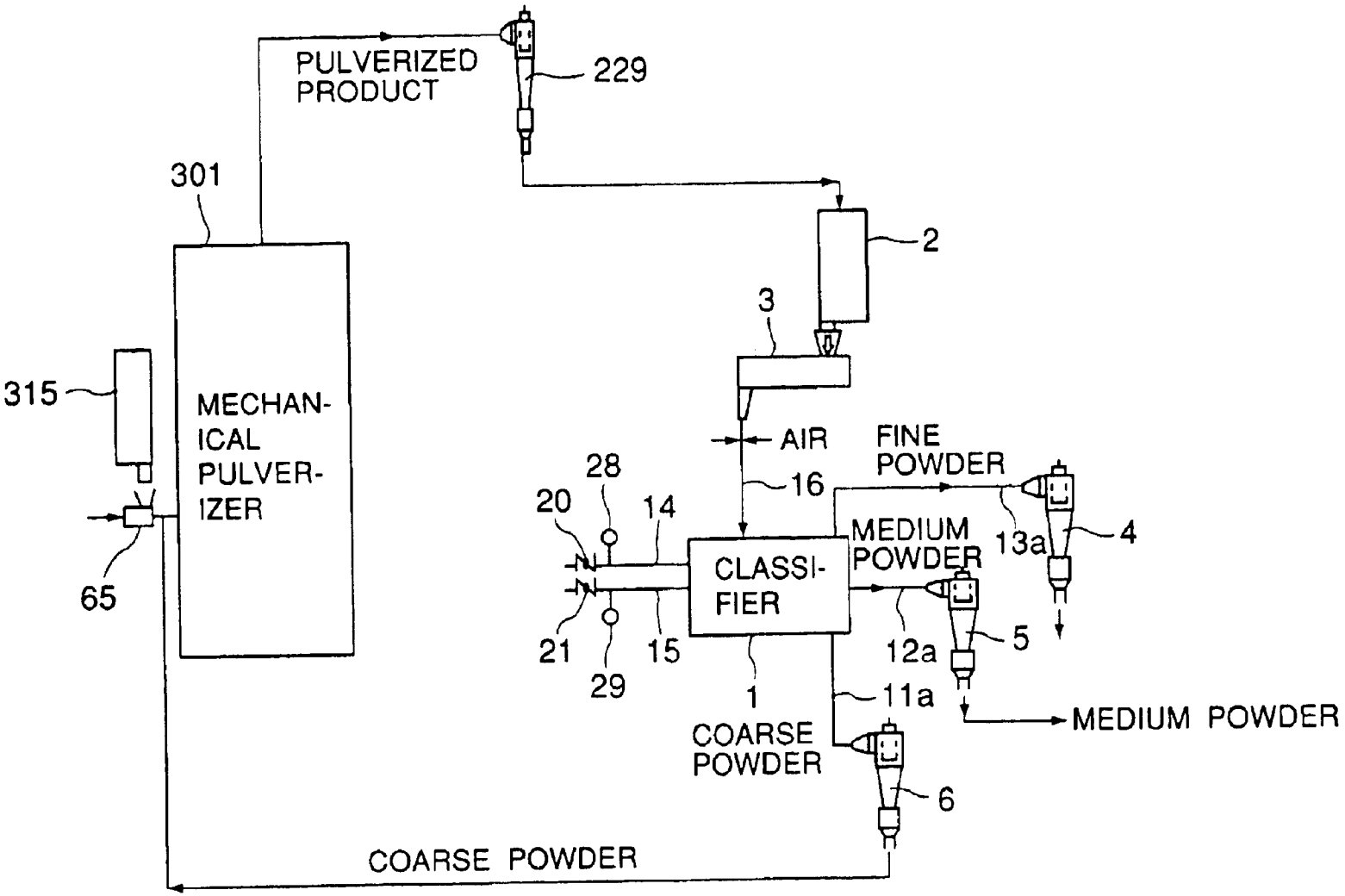
FIG. 2 illustrates an example of the apparatus system for practicing a toner production process according to the invention.

FIG. 2 illustrates an embodiment of such a toner production apparatus system. In the apparatus system, a powdery feed comprising at least a binder resin, magnetic iron oxide and a wax is supplied. For example, a binder resin, magnetic iron oxide and a wax are melt-kneaded, cooled and coarsely crushed to form such a powdery feed.

Referring to FIG. 2, the powdery feed is introduced at a prescribed rate to a mechanical pulverizer 301 as pulverization means via a first metering feeder 315. The introduced powdery feed is instantaneously pulverized by the mechanical pulverizer 301, introduced via a collecting cyclone 229 to a second metering feeder 2 and then supplied to a multi-division pneumatic classifier 1 via a vibration feeder 3 and a feed supply nozzle 16.

In the apparatus system, the feed rate to the multi-division pneumatic classifier, via the second metering feeder 2, may preferably be set to 0.7–1.7 times, more preferably 0.7–1.5 times, further preferably 1.0–1.2 times, the feed rate to the mechanical pulverizer 301 from the first metering feeder 315, in view of the toner productivity and production efficiency.

Figure 6:
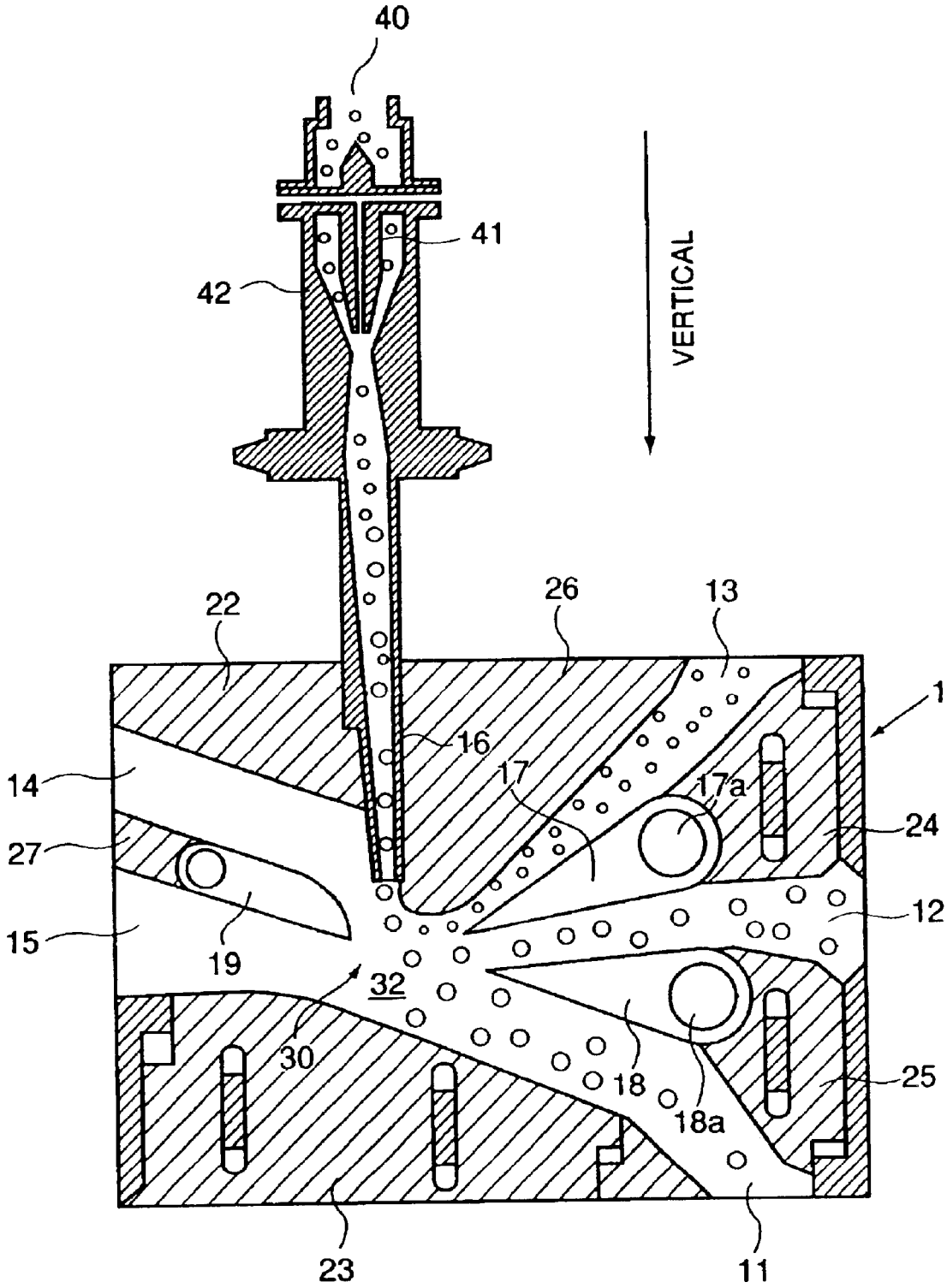
FIG. 6 is a schematic sectional view of a multi-division pneumatic classifier used in a toner classification step in a toner production process of the invention.

A pneumatic classifier is generally incorporated in an apparatus system while being connected with other apparatus through communication means, such as pipes. FIG. 2 illustrates a preferred embodiment of such an apparatus system. The apparatus system shown in FIG. 2 includes the multi-division classifier 1 (the details of which are illustrated in FIG. 6), the metering feeder 2, the vibration feeder 3, and collecting cyclones 4, 5 and 6, connected by communication means.

In the apparatus system, the pulverized feed is supplied to the metering feeder 2 and then introduced into the three-division classifier 1 via the vibration feeder 3 and the feed supply nozzle 16 at a flow speed of 10–350 m/sec. The three-division classifier 1 includes a classifying chamber ordinarily measuring 10–50 cm×10–50 cm×3–50 cm, so that the pulverized feed can be classified into three types of particles in a moment of 0.1–0.01 sec or shorter. By the classifier 1, the pulverized feed is classified into coarse particles, medium particles and fine particles. Thereafter, the coarse particles are sent out of an exhaust pipe 1*a* to a collecting cyclone 6 and then recycled to the mechanical pulverizer 301. The medium particles are sent through an exhaust pipe 12*a* and discharge out of the system to be recovered by a collecting cyclone 5 as a toner product. The fine particles are discharged out of the system via an exhaust pipe 13*a* and are discharged out of the system to be collected by a collecting cyclone 4. The collected fine particles are supplied to a melt-kneading step for providing a powdery feed comprising toner ingredients for re-utilization, or are discarded. The collecting cyclones 4, 5 and 6 can also function as a suction vacuum generation means for introducing by sucking the pulverized feed to the classifier chamber via the feed supply nozzle. The coarse particles classified out of the classifier 1 may preferably be re-introduced to the first metering feeder 315 to be mixed with a fresh powdery feed and re-pulverized in the mechanical pulverizer. Into the classifier 1, air for classification is introduced through in-take pipes 14 and 15 which are equipped with first and second in-take air adjust means 20 and 21, respectively, and static pressure gauges 28 and 29, respectively.

The rate of re-introduction of the coarse particles to the mechanical pulverizer 301 from the pneumatic classifier 1 may preferably be set to 0–10.0 wt. %, more preferably 0–5.0 wt. %, of the pulverized feed supplied from the second metering feeder 2 in view of the toner productivity. If the rate of re-introduction exceeds 10.0 wt. %, the powdery dust concentration in the mechanical pulverizer 301 is raised to increase the load on the pulverizer 301, and the toner productivity can be lowered due to difficulties, such as overpulverization heat causing toner surface deterioration, isolation of the magnetic iron oxide particles from the toner particles and melt-sticking onto the apparatus wall.

The powdery feed to the apparatus system may preferably have a particle size distribution such that a least 95 wt. % passes through 18-mesh (having an opening of 1000 μm) and at least 90 wt. % remains on 100 mesh (having an opening of 150 μm) (according to ASTME-11-61).

In order to produce a toner having a weight-average particle size (D4) of at most 10 μm, preferably at most 8 μm, and a narrow particle size distribution, the pulverized product out of the mechanical pulverizer may preferably satisfy a particle size distribution including a weight-average particle size of 4–10 μm, at most 70% by number, more preferably at most 65% by number of particles of at most 4.0 μm, and at most 25% by volume, more preferably at most 20% by volume, of particles of at least 10.1 μm. Further, the medium particles classified out of the classifier 1 may preferably satisfy a particle size distribution including a weight-average particle size of 5–10 μm, at most 40% by number, more preferably at most 35% by number of particles of at most 4.0 μm, and at most 25% by volume, more preferably at most 20% by volume, of particles of at least 10.1 μm.

Figure 7:
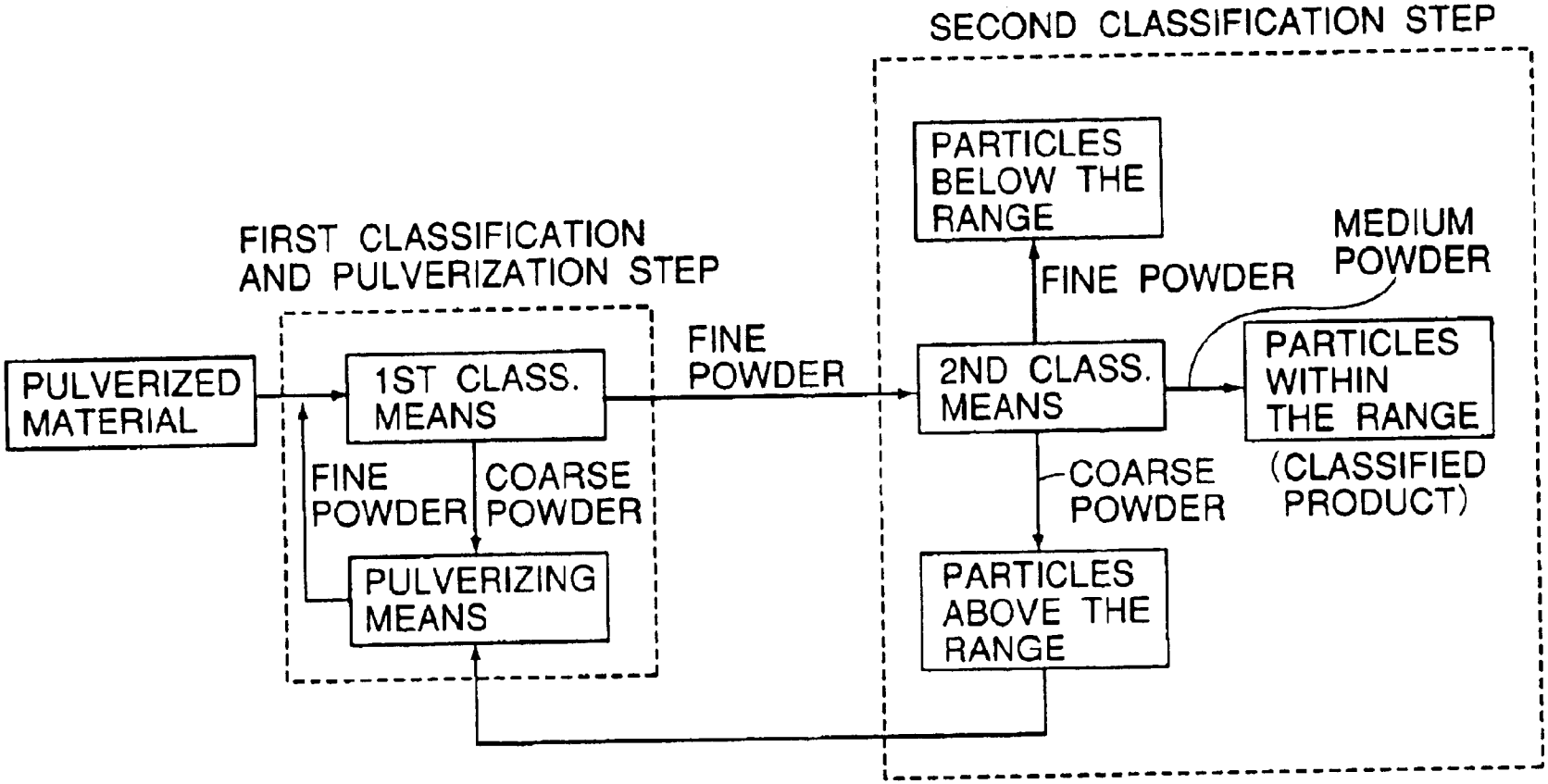
FIG. 7 is a flow chart for illustrating a conventional toner production process.

The apparatus system shown in FIG. 1 does not include a first classification step, as contained in the conventional system shown in FIG. 7, prior to the pulverization step, and includes a single pass of pulverization step and classification step.

The mechanical pulverizer 301 suitably incorporated in the apparatus system of FIG. 2 may be provide by a commercially available pulverizer, such as "KTM" (available from Kawasaki Jukogyo K.K.) or "TURBOMILL" (available from Turbo Kogyo K.K.), as it is, or after appropriate re-modeling.

Figure 3:
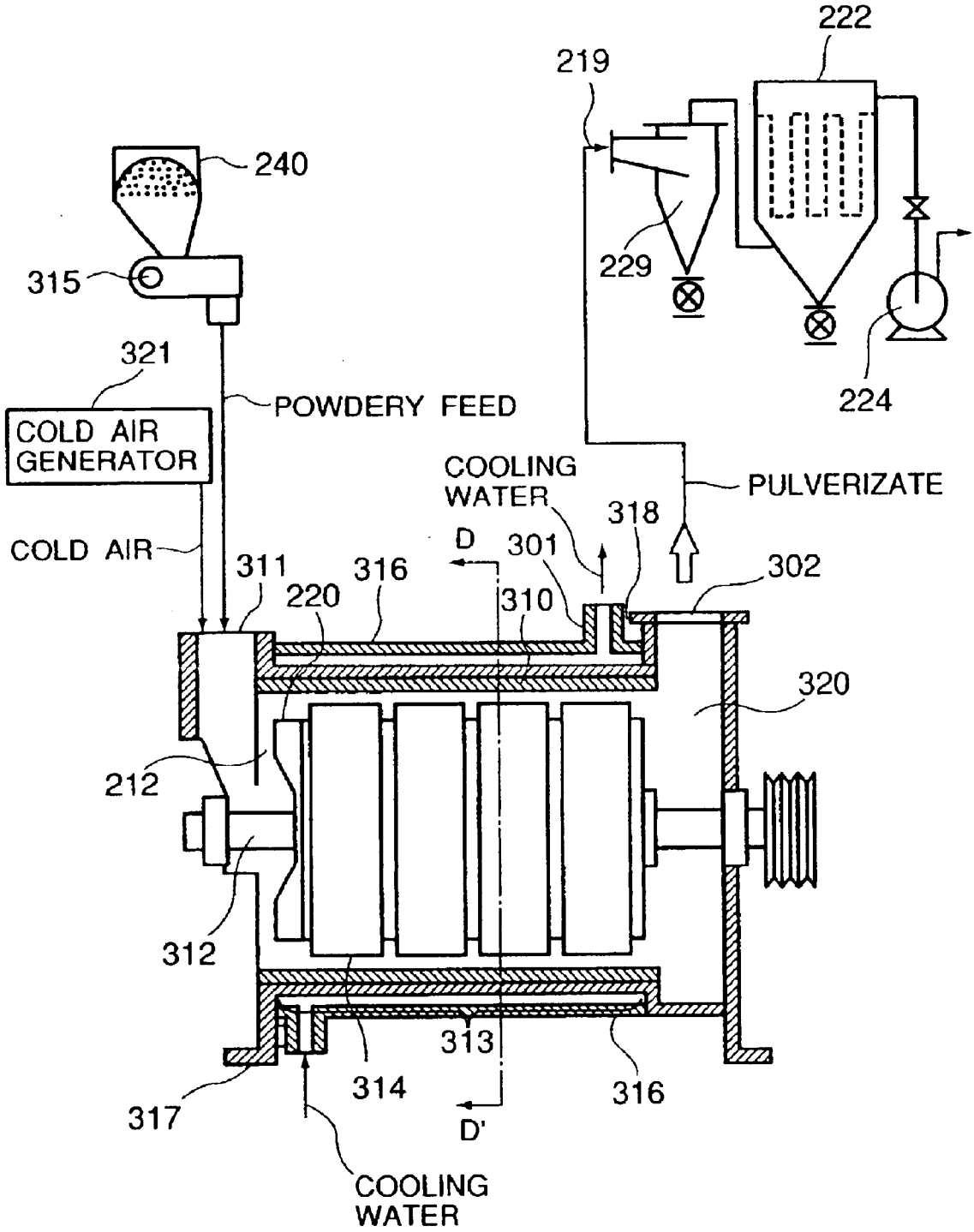
FIG. 3 is a schematic sectional view of a mechanical pulverizer used in a toner pulverization step in a toner production process of the invention.
Figure 4:
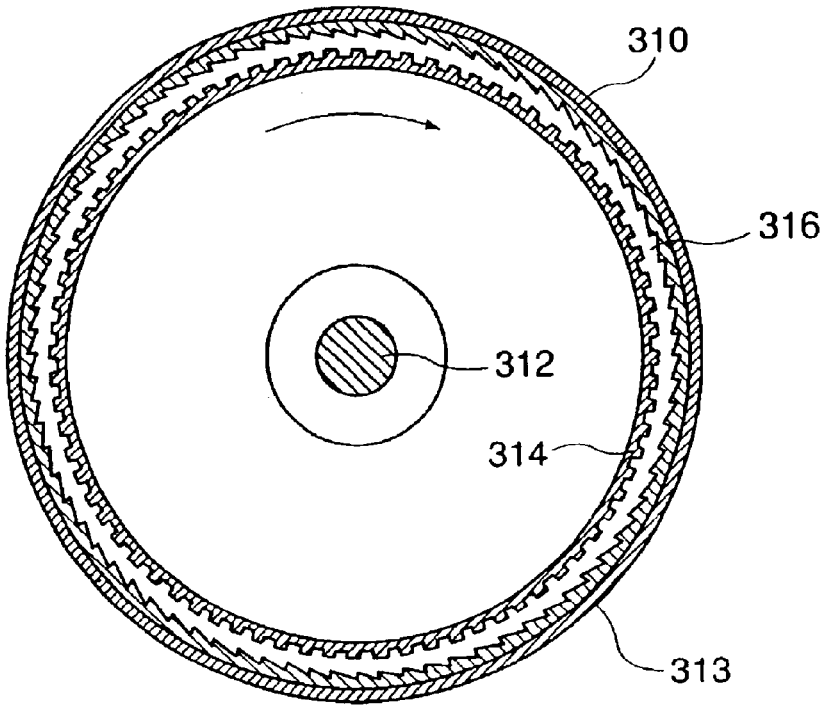
FIG. 4 is a schematic sectional view of a D–D' section in FIG. 3.
Figure 5:
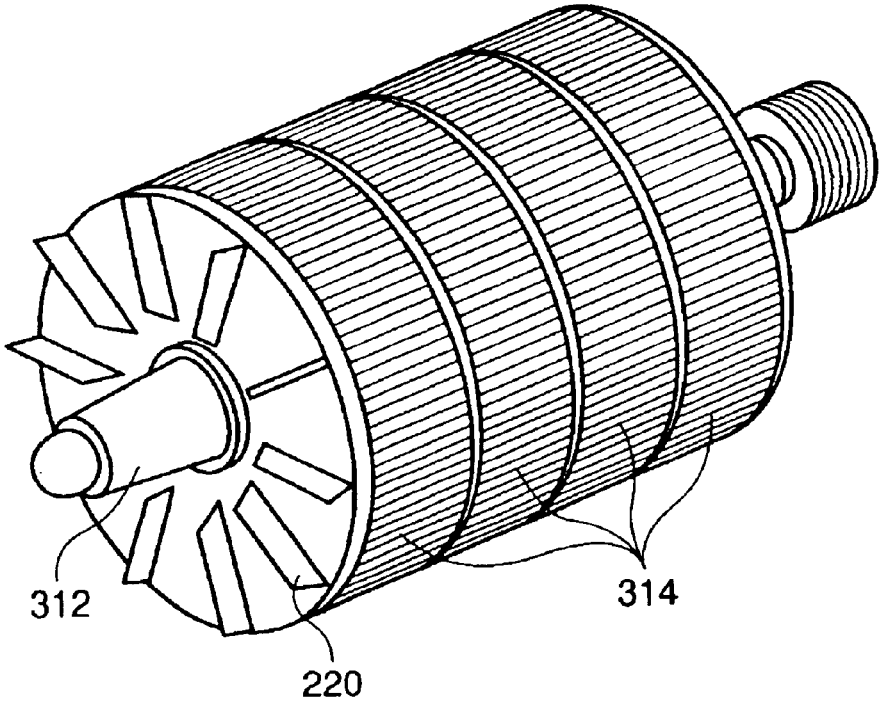
FIG. 5 is a perspective view of a rotor contained in the pulverizer of FIG. 3.

It is particularly preferred to adopt a process using a mechanical pulverizer as illustrated in FIGS. 3-5 as a process capable of producing a toner including controlled shape of toner particles and controlled degree of magnetic iron oxide exposed at the toner particle surfaces. This is also preferred so as to allow easy pulverization of the powdery feed and realize effective toner production.

In contrast thereto, according to a conventional impingement-type pneumatic pulverizer wherein toner particles are caused to impinge onto an impingement surface of an impingement member to pulverize the toner particles under the action of the impact force at the time of the impingement, magnetic iron oxide particles are liable to be isolated at the time of the impingement. Further, the resultant toner particles are made indefinitely and angularly shaped, so that the magnetic iron oxide is liable to be excessively exposed at the surface of the toner particles. Such toner particles produced through the impingement-type pneumatic pulverizer ca be subjected to modification of particle shape and surface property by application of mechanical impact (as by using a hybridizer). However, in order to provide a circularity required for accomplishing the effect of the present invention, the toner particle shape has to be made closer to spheres by heat-application, so that it becomes difficult to also satisfy the magnetic iron oxide exposure degree at the toner particle surfaces as another requirement of the present invention.

Now, the organization of a mechanical pulverizer will be described with reference to FIGS. 3–5. FIG. 3 schematically illustrates a sectional view of a mechanical pulverizer; FIG. 4 is a schematic sectional view of a D–D' section in FIG. 3, and FIG. 5 is a perspective view of a rotor 314 in FIG. 3. As shown in FIG. 3, the pulverizer includes a casing 313; a jacket 316; a distributor 220; a rotor 314 comprising a rotating member affixed to a central rotation shaft 312 and disposed within the casing 313, the rotor 314 being provided with a large number of surface grooves (as shown in FIG. 5) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material.

In operation, a powdery feed is supplied from a hopper 240 and introduced at a prescribed rate by means of a first metering feeder 315 via the feed port 311 into a processing chamber, where the powdery feed is pulverized in a moment under the action of an impact caused between the rotor 314 rotating at a high speed and the stator 310, respectively provided with a large number of surface grooves, a large number of ultra-high speed eddy flow occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 229, a bag filter 222 and a suction blower 224 to be discharged out of the system. In the mechanical pulverizer, a powdery feed can be pulverized in a desirable manner without increasing the fine powder faction and the coarse powder fraction.

The conveying air is cold air generated by a cold air generation means 321 and introduced together with the powdery feed, and the pulverizer main body is covered with a jacket 316 for flowing cooling water (preferably, non-freezing liquid comprising ethylene glycol, etc.), so as to maintain the temperature within the processing chamber at 20 to −40° C. or below, more preferably 10 to −30° C., further preferably 0 to −25° C., in view of the toner productivity. This is effective for suppressing the surface deterioration of toner particles due to pulverization heat, particularly the liberation of magnetic iron oxide particles present at the toner particle surfaces and melt-sticking of toner particles onto the apparatus wall, thereby allowing effective pulverization of the powdery feed. A temperature exceeding 0° C. in the processing chamber is undesirable for the above reason.

The cooling water is introduced into the jacket 316 via a supply port 317 and discharged out of a discharge port 318.

In the pulverization operation, it is preferred to set the temperature T1 in a whirlpool chamber 212 (inlet temperature) and the temperature T2 in a rear chamber (outlet temperature) so as to provide a temperature difference ΔT (=T2−T1) of 30–80° C., more preferably 35–75° C., further preferably 37–72° C., thereby suppressing the surface deterioration of toner particle surfaces, particularly isolation of the magnetic iron oxide particles from the toner particle surfaces, and effectively pulverizing the powdery feed. A temperature difference ΔT of below 30° C. suggests a possibility of short pass of the powdery feed without effective pulverization thereof, thus being undesirable in view of the toner performances. On the other hand, ΔT>80° C. suggests a possibility of the overpulverization, resulting in the liberation of magnetic iron oxide particles from and surface deterioration due to heat of the toner particles and melt-sticking of toner particles onto the apparatus wall and thus adversely affecting the toner productivity.

It is preferred that the inlet temperature (T1) in the mechanical pulverizer is set to at most 0° C. and a value which is lower than the glass transition temperature (Tg) of the binder resin by 60–75° C. As a result, it is possible to suppress the surface deterioration of toner particles due to heat, particularly the liberation of magnetic iron oxide particles at the toner particle surfaces, and allow effective pulverization of the powdery feed. Further, the outlet temperature (T2) may preferably be set to a value which is lower by 5–30° C., more preferably 10–20° C., than Tg. As a result, it becomes possible to suppress the surface deterioration of toner particles due to heat, particularly the liberation of magnetic iron oxide particles at the toner particle surfaces, and allow effective pulverization of the powdery feed.

The rotor 314 may preferably be rotated so as to provide a circumferential speed of 80–180 m/s, more preferably 90–170 m/s, further preferably 100–160 m/s. As a result, it becomes possible to suppress insufficient pulverization or overpulverization, suppress the isolation of magnetic iron oxide particles due to the overpulverization and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in the isolation of magnetic iron oxide particles. Further, the overpulverization is also liable to result in surface deterioration of toner particles due to heat, particularly the liberation of magnetic iron oxide particles at the toner particle surfaces, and also melt-sticking of the toner particles onto the apparatus wall, thus adversely affecting the toner productivity.

Further, the rotor 314 and the stator 310 may preferably be disposed to provide a minimum gap therebetween of 0.5–10.0 mm, more preferably 1.0–5.0 mm, further preferably 1.0–3.0 mm. As a result, it becomes possible to suppress insufficient pulverization or overpulverization and the liberation of magnetic iron oxide particles due to the overpulverization, and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization resulting in the isolation of magnetic iron oxide particles. Further, the overpulverization is also liable to result in surface deterioration of toner particles due to heat, particularly the liberation of magnetic iron oxide particles at the toner particle surfaces, and also melt-sticking of the toner particles onto the apparatus wall, thus adversely affecting the toner productivity.

Further, by appropriately controlling the surface roughness of the pulverization surfaces (i.e., mutually opposing outer and inner surfaces) of the rotor 314 and the stator 310, it becomes possible to control the occurrence of isolated magnetic iron oxide particles and provide magnetic toner particles showing good developing performance, transferability and chargeability. More specifically, the surface roughnesses of the pulverization surfaces of the rotor 314 and the stator 310 may preferably be set to provide a central line-average roughness Ra of at most 10.0 μm, more preferably 2.0–10.0, a maximum roughness Ry of at most 60.0 μm, more preferably 25.0–60.0 μm, and a ten point-arrange roughness Rz of at most 40.0 μm, more preferably 20.0 μm. If Ra>10.0 μm, Ry>60.0 μm or Rz>40.0 μm, overpulverization is liable to occur at the time of pulverization, and the overpulverization is liable to result in surface deterioration of toner particles due to heat, particularly the isolation of magnetic iron oxide particles at the toner particle surfaces, and also melt-sticking of toner particles onto the apparatus wall, thus adversely affecting the toner productivity.

The above-mentioned parameters regarding the surface roughness are based on values measured by using a laser focus displacement meter ("LT-8100", available from K.K. Keyence) and a surface shape measurement software ("Tres-Vallet Lite", available from Mitani Shoji K.K.). Several times of measurement are made by selecting measurement points at random to obtain average values. For the measurement, a basis length is set to 8 mm, a cut-off value is set to 0.8 mm, and a movement speed is set to 90 μm/sec.

The significance of the above-mentioned surface roughness parameters is supplemented hereinbelow. A central line roughness Ra is determined based on a roughness curve on which a basis length L (=8 mm) is sampled along a central line, and for the sampled length, a roughness curve is represented by Z=f(x) while taking an X-axis along the central line and a Z-axis on a vertical roughness to determine Ra according to the following formula:

$$Ra=(1/L)\cdot\int|f(x)|dx.$$

Further, the maximum roughness Ry is determined as a difference in height between the highest peak and the lowest valley taken along the basis length. Further, the ten point-average roughness Rz is determined as a sum of an absolute value of an average height of first to fifth highest peaks and an absolute value of an average depth of first to fifth deepest valleys, respectively taken in the basis length portion. The rotor and/or the stator may be surface-roughened according to known methods. The roughened surfaces may preferably be subjected to an anti-wearing treatment, which is preferably nitriding, plating, flame spraying or coating with self-fluxing alloy.

For example, the nitriding is a surface-hardening treatment for improving the anti-wear resistance and anti-fatigue resistance of the treated material and may be effected to cause nitrogen to penetrate from the surface entirely or locally at an appropriately elevated temperature for an appropriate period, thereby forming a nitride layer.

Thus, the pulverization surfaces of the rotor and/or the stator may preferably be provided through a surface-roughening treatment as a pretreatment and then an anti-wearing treatment as a post-treatment, so as to effect the pulverization step stably over a long period for providing a toner with a good developing performance while suppressing the occurrence of isolated magnetic iron oxide particles.

The effective pulverization achieved by the above-mentioned mechanical pulverizer allows the omission of a pre-classification step liable to result in overpulverization and omission of the large-volume pulverization air supply required in pneumatic pulverizer as used in the system of FIG. 7.

Next, a pneumatic classifier as a preferred classification means for toner production.

FIG. 6 is a sectional view of an embodiment of a preferred multi-division pneumatic classifier.

Referring to FIG. 6, the classifier includes a side wall 22 and a G-block 23 defining a portion of the classifying chamber, and classifying edge blocks 24 and 25 equipped with knife edge-shaped classifying edges 17 and 18. The G-block 23 is disposed slidably laterally. The classifying edges 17 and 18 are disposed swingably about shafts 17*a* and 18*a* so as to change the positions of the classifying edge tips. The classifying edge blocks 17 and 18 are slidable laterally so as to change horizontal positions relatively together with the classifying edges 17 and 18. The classifying edges 17 and 18 divide a classification zone of the classifying chamber 32 into 3 sections.

A feed port 40 for introducing a powdery feed is positioned at the nearest (most upstream) position of a feed supply nozzle 16, which is also equipped with a high-pressure air nozzle 41 and a powdery feed-introduction nozzle 42 and opens into the classifying chamber 32. The nozzle 16 is disposed on a right side of the side wall 22, and a Coanda block 26 is disposed so as to form a long elliptical arc with respect to an extension of a lower tangential line of the feed supply nozzle 16. A left block 27 with respect to the classifying chamber 32 is equipped with a gas-intake edge 19 projecting rightwards in the classifying chamber 32. Further, gas-intake pipes 14 and 15 are disposed on the left side of the classifying chamber 32 so as to open into the classifying chamber 32. Further, the gas-intake pipes 14 and 15 are equipped with first and second gas introduction control means 20 and 21, like dampers, and static pressure gauges 28 and 29 (as shown in FIG. 2).

The positions of the classifying edges 17 and 18, the G-block 23 and the gas-intake edge 18 are adjusted depending on the pulverized powdery feed to the classifier and desired particle size of the product toner.

On the right side of the classifying chamber 32, there are disposed exhaust ports 11, 12 and 13 communicative with the classifying chamber corresponding to respective classified fraction zones. The exhaust ports 11, 12 and 13 are connected with communication means such as pipes (11*a*, 12*a* and 13*a* as shown in FIG. 2) which can be provided with shutter means, such as valves, as desired.

The feed supply nozzle 16 may comprise an upper straight tube section and a lower tapered tube section. The inner diameter of the straight tube section and the inner diameter of the narrowest part of the tapered tube section may e set to a ratio of 20:1 to 1:1, preferably 10:1 to 2:1, so as to provide a desirable introduction speed.

The classification by using the above-organized multi-division classifier may be performed in the following manner. The pressure within the classifying chamber 32 is reduced by evacuation through at least one of the exhaust ports 11, 12 and 13. The powdery feed is introduced through the feed supply nozzle 16 at a flow speed of preferably 10–350 m/sec under the action of a flowing air caused by the reduced pressure and an ejector effect caused by compressed air ejected through the high-pressure air supply nozzle and ejected to be dispersed in the classifying chamber 32.

The particles of the powdery feed introduced into the classifying chamber 32 are caused to flow along curved lines under the action of the Coanda effect exerted by the Coanda block 26 and the action of introduced gas, such as air, so that coarse particles form an outer stream to provide a first fraction outside the classifying edge 18, medium particles form an intermediate stream to provide a second fraction between the classifying edges 18 and 17, and fine particles form an inner stream to provide a third fraction inside the classifying edge 17, whereby the classified coarse particles are discharged out of the exhaust port 11, the medium particles are discharge out of the exhaust port 12 and the fine particles are discharged out of the exhaust port 13, respectively.

In the above-mentioned powder classification, the classification (or separation) points are principally determined by the tip positions of the classifying edges 17 and 18 corresponding to the lowermost part of the Coanda block 26, while being affected by the suction flow rates of the classified air stream and the powder ejection speed through the feed supply nozzle 16.

According to the toner production system of the present invention, it is possible to effectively produce a toner having a weight-average particle size of 4–12 $\mu$m, particularly 5–10 $\mu$m, and a narrow particle size distribution by controlling the pulverization and classification conditions.

A characteristic feature of the toner production process according to the present invention is that it includes a surface-treatment step of passing a classified medium powder fraction from a classification step through a surface-treatment apparatus wherein a mechanical impact force is continuously applied to the powdery feed. The surface-treatment step will be described with reference to FIGS. 10–13.

Figure 10:
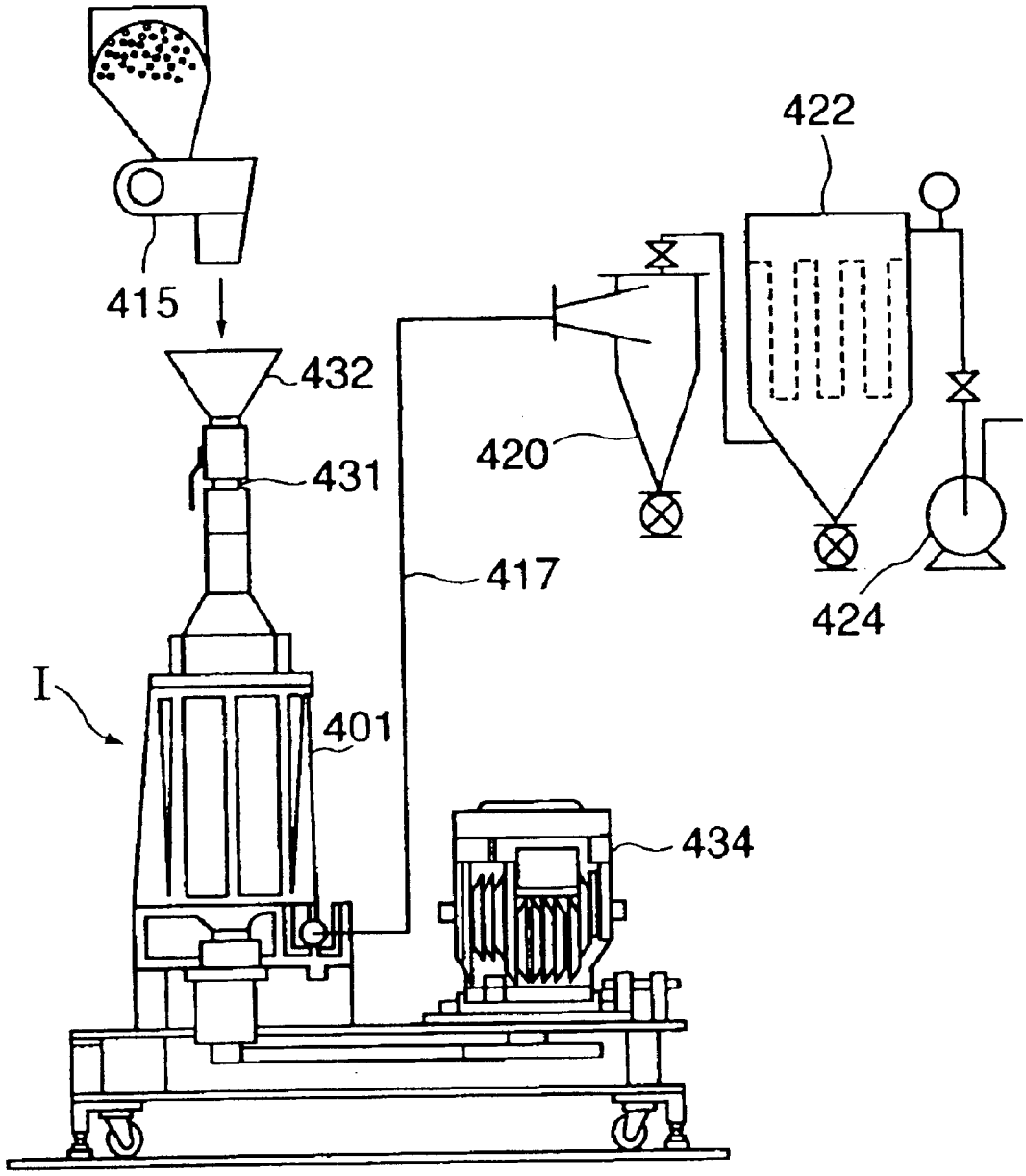
FIG. 10 schematically illustrates an embodiment of surface treatment apparatus system used in a toner production process of the invention.
Figure 11:
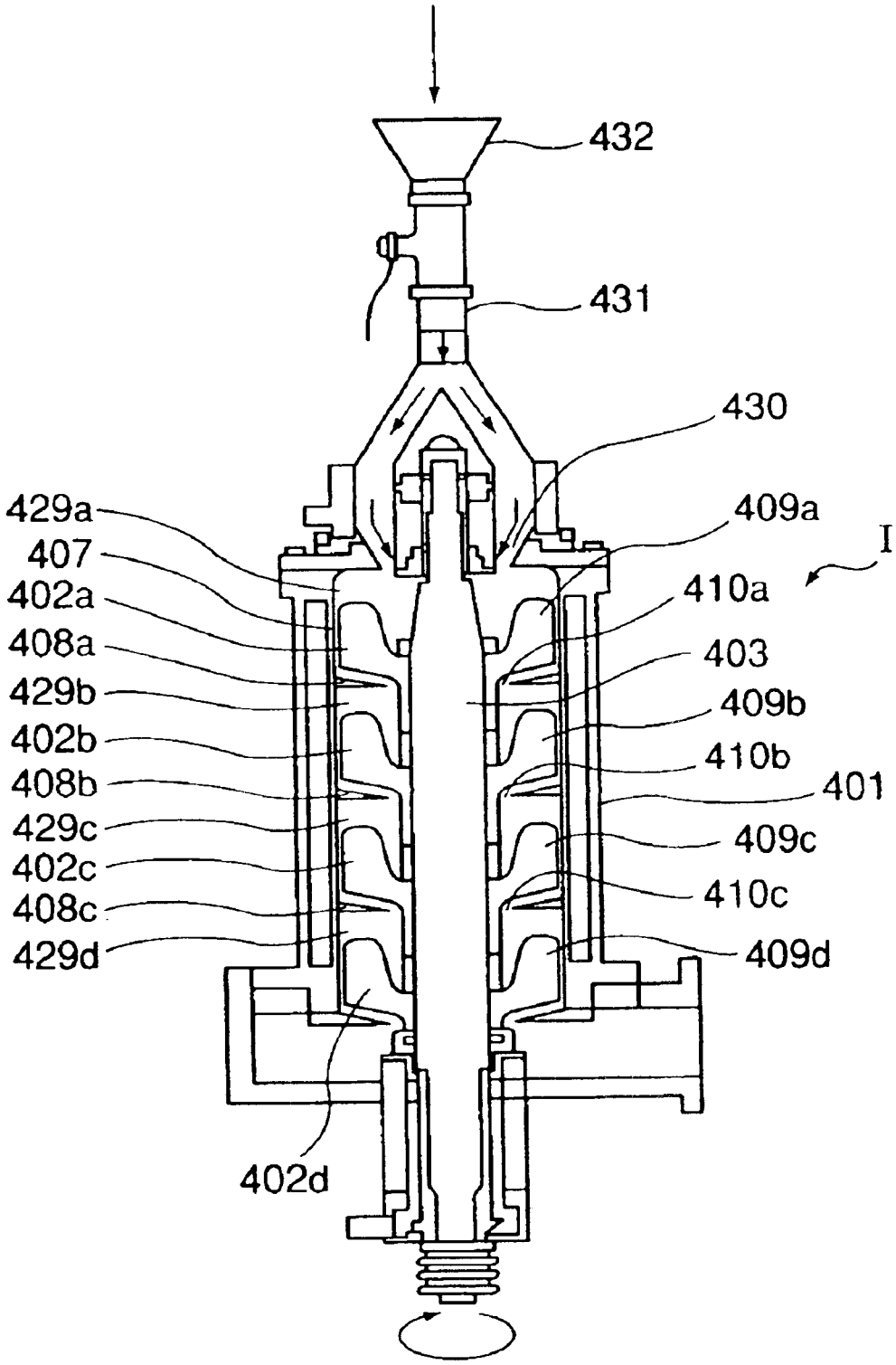
FIG. 11 is a schematic sectional view of a surface treatment apparatus used in a production process of the invention.
Figure 12:
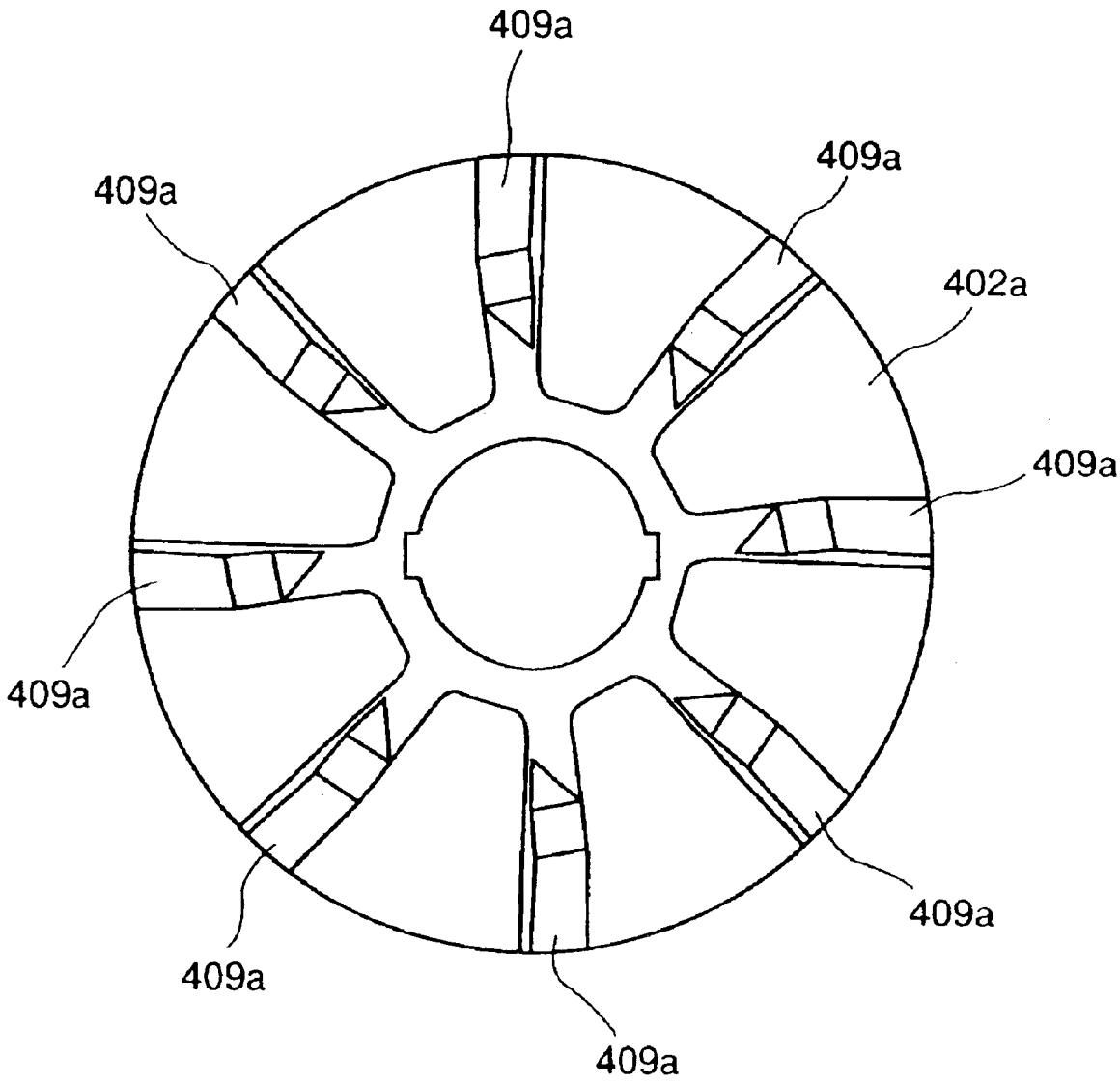
FIGS. 12 and 13 are a plan view and a vertical sectional view, respectively, of a rotor in the surface treatment apparatus of FIG. 11.
Figure 13:
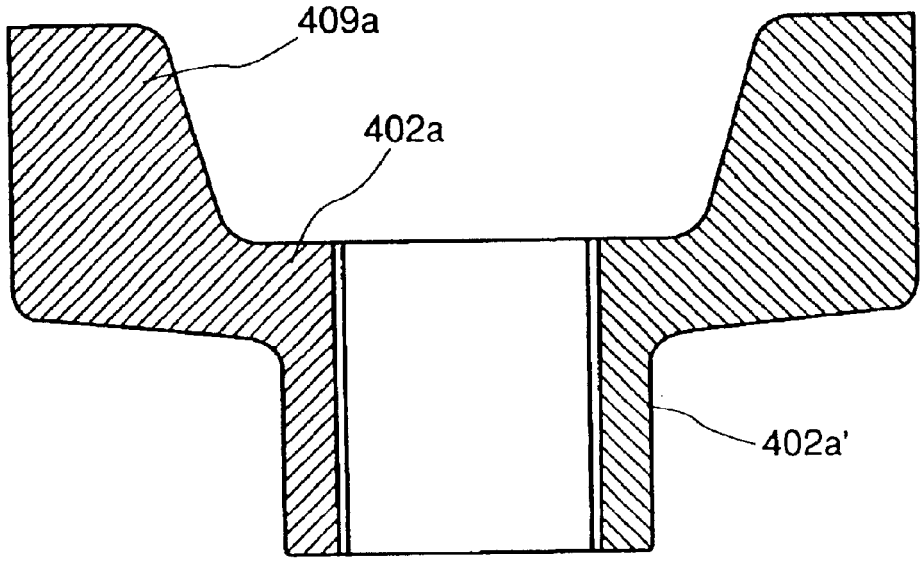

FIG. 10 schematically illustrates a surface-treatment apparatus system; FIG. 11 is a schematic partial sectional view of a processing section 401 of a surface-treatment apparatus I in the system of FIG. 10; and FIGS. 12 and 13 are a plan view and a vertical sectional view, respectively, of a rotor installed in the surface-treatment apparatus.

In operation of the surface-treatment apparatus, toner particles (medium powder from the pneumatic classifier 1 in the system of FIG. 2) are pushed toward an inner wall of the casing by the action of a centrifugal force exerted by blades rotating at a high speed, and are repetitively supplied with a thermo-mechanical impact force including a compression force and a frictional force, thereby being surface-treated. As shown in FIG. 11, four rotors (or rotating blades) 402*a*, 402*b*, 402*c* and 402*d* are installed vertically in the processing section 401. The rotors 402*a*–402*d* are affixed to a rotation drive shaft 403 and rotated together therewith by an electric motor (434 in FIG. 10), so as to exhibit an outermost peripheral speed of 30–60 m/s. The rotors 402*a*–402*d* are provided with blades 409*a*–409*d* integral therewith for causing an air stream, and a suction blower (424 in FIG. 10) is driven to cause a suction air stream which is equal to or even larger than the air stream caused by the blades 409*a*–409*d*. As a result, toner particles from a feeder 415 are introduced by suction together with air into a hopper 432, and the toner particles are further introduced via a supply pipe 431 and a supply port 430 into a central region of a first cylindrical processing chamber 429*a*, where the toner particles are surface-treated by the blade 409*a* and a side wall 407. Then, the surface-treated toner particles are introduced into a central region of a second cylindrical processing chamber 429*b* through a first powder outlet port 410*a* provided so as to be surrounded by a guide plate 408*a*, where the toner particles are further surface-treated for sphering by the blade 409*b* and the side wall 407.

The toner particles surface-treated in the second cylindrical processing chamber 429*b* are further introduced into a central region of a third cylindrical processing chamber 429*c* through a second powder outlet port 410*b* surrounded by a guide plate 408*b* to be further surface-treated by the blade 409*c* and the side wall 407. The toner particles are further introduced into a central region of a fourth cylindrical processing chamber 429*d* through a third powder outlet port 410*c* surrounded by a guide plate 409*c* to be further surface-treated with the blade 409*d* and the side wall 407. The air introduced for conveying the toner particles together with the toner particles is moved via the first to fourth cylindrical processing chambers 429*a*–429*d*, and discharged through an exhaust pipe 417, a cyclone 420, a bag filter 422 and the suction blower 424 out of the apparatus system.

The toner particles introduced into the respective cylindrical processing chambers 429*a*–429*d* are instantaneously imparted with a mechanical impact by the respective blades 409*a*–409*d* and caused to impinge onto the side wall 407 to receive a mechanical impact. By the rotation of the blades 409*a*–409*d* having a prescribed size and provided as integral parts to the rotors 402*a*–402*d*, a convection circulating from the periphery to the central region is caused. While residing in the cylindrical processing chambers 429*a*–429*d*, the toner particles are continually imparted with such mechanical impact forces and surface-treated under the action of heat generated by the mechanical impact forces.

In a specific operation, each rotor is rotated at a peripheral speed of 30–60 m/s, and toner particles are supplied from the auto-feeder 415 at a rate of 10–30 kg/hr under a suction air flow of 2–4 $m^3$/min. at the blower 424. In the surface-treatment step, it is preferred that the air stream is held at a temperature which is lower by at least 5° C. than the glass transition temperature Tg of the toner binder resin and the toner particles are continually imparted with a mechanical impact to be surface-treated while flowing through the surface-treatment apparatus without stagnation. It is also preferred that the air stream is held at a temperature which is lower by at least 20° C. than the DSC heat-absorption main peak temperature of the wax in the toner. If the air stream temperature for the surface-treatment is above-specified temperature, the toner particle surfaces are liable to be denaturated, e.g., exudation and re-aggregation at the toner particle surfaces of the wax dispersed in the toner particles due to accumulation of frictional and impact heat caused during the surface-treatment.

In the toner production process of the present invention, as a result of the combination of the above-mentioned use of the mechanical pulverizer and the surface-treatment by passing through the surface-treatment apparatus for continuously applying a mechanical impact force to the toner particles, the toner particles can be surface-treated in a short time at a relatively low temperature in a state free from heat accumulation and while effectively suppressing the heating of toner particles due to mechanical impact and friction, whereby the circularity and the exposure amount of magnetic iron oxide at toner particle surfaces of the toner can be effectively controlled.

Various machines are commercially available for production of the toner according to the present invention. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Counter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukwa Shoji K.K.). As the sieving apparatus, Ultrasonic (Koei Sangyo K.K.), Rezona Sieve and Gyrosifter (Tokuju Kosaku K.K.), Ultrasonic System (Dalton K.K.), Sonicreen (Shinto Kogyo K.K.), Turboscreener (Turbo Kogyo K.K.), Microshifter (Makino Sangyo K.K.), and circular vibrating sieves.

As for the pulverization, classification and surface-treatment steps, however, it is preferred to use the apparatus system described with reference to FIGS. 1 to 6 and 10 to 13.

Now, an embodiment of the image forming method according to the present invention will be described with reference to FIG. 14.

Figure 14:
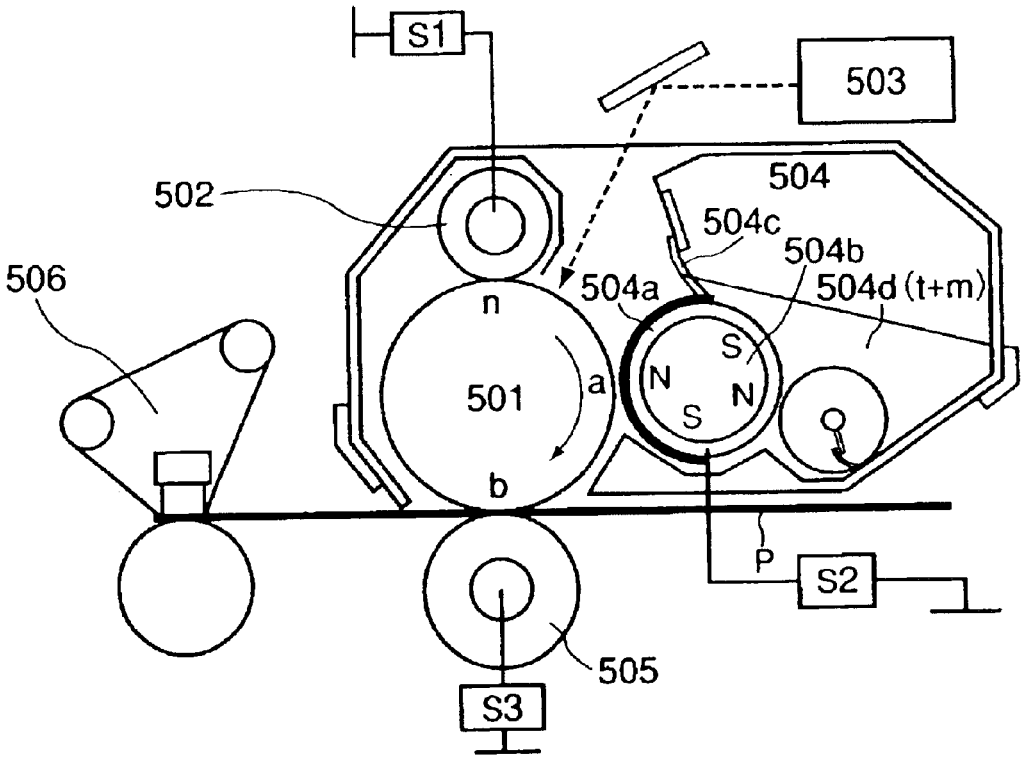
FIGS. 14 and 15 each illustrate an embodiment of image forming apparatus suitable for using a magnetic toner of the invention.

FIG. 14 illustrates an image forming apparatus according to dry electrophotography and including a cleanerless system (adopting a developing and cleaning step). The image forming apparatus is equipped with a process cartridge from which a cleaning unit including a cleaning member such as a cleaning blade has been removed, and uses a magnetic monocomponent developer (i.e., a magnetic toner) in a non-contact developing system wherein a developer layer on a developer-carrying member (toner-carrying member) is free from contact with an image-bearing member at the developing position.

Referring to FIG. 14, a rotating drum-type OPC (organic photoconductor) photosensitive member 501 (as an electrostatic image-bearing member) is driver in rotation in an indicated arrow a direction and is charged by a charging roller as a contact charging means 502. The charging roller 502 is pressed against the photosensitive member 501 so as to form a charging nip n therebetween and is rotated in an opposite surface moving direction with respect to the photosensitive member 501. On the charging roller 502 surface, electroconductive powder m is applied so as to form a substantially uniform mono-particle layer.

A metal core 502 of the charging member is designed to receive a DC voltage of −700 volts from a charging bias voltage supply source S1 (to be disposed on the main assembly side). In this embodiment, the photosensitive member 501 surface is uniformly charged to a potential (−680 volts) which is substantially equal to the voltage supplied to the charging roller 502, by the direct injection charging scheme.

The photosensitive member 501 is also designed to be exposed to a laser beam emitted from a laser beam scanner 503 (to be disposed on the main assembly side) which includes a laser diode, a polygonal mirror, etc. The laser beam scanner 503 outputs laser beam (wavelength=740 nm) of which intensity has been modified corresponding to time-serial electrical digital image signals based on objective image data, and the uniformly charged surface of the photosensitive member 501 is scanningly exposed to the laser beam, whereby an electrostatic latent image corresponding to the objective image data is formed on the photosensitive member 501.

The cartridge includes a developing device 504, by which the electrostatic latent image on the photosensitive member 501 is developed into a toner image. The developing device 504 is a reversal development device including magnetic toner 504*d* comprising magnetic toner particles (t) and electroconductive fine powder (m), and also a 16 mm-dia. non-magnetic developing sleeve 504*a* enclosing a magnet roll 504*b*. The developing sleeve 504*a* is disposed opposite to the photosensitive member 501 with a gap of 320 $\mu$m therefrom in the developing zone and is designed to rotate at a circumferential speed which is 120% of the photosensitive member 501 in the identical surface moving direction.

The magnetic toner 504*d* is applied in a thin layer on the developing sleeve 504*a* by the elastic blade 504*c* while being simultaneously charged thereby.

The magnetic toner 504*d* applied on the developing sleeve 504*a* is conveyed to the developing zone a along with the rotation of the developing sleeve 504*a*.

The developing sleeve 504*a* is also supplied with a developing bias voltage which is a super-position of a DC voltage of −420 volts and a rectangular AC voltage of f=1500 Hz and Vpp=1600 volts (electric field intensity=$5\times10^6$ volts/m) from a developing bias voltage source S2 to effect mono-component jumping development between the developing sleeve 804*a* and the photosensitive member 501.

The apparatus further includes a medium-resistivity transfer roller 505 (as a contact transfer means), which is abutted at a linear pressure of $0.16\times10^{-2}$–$24.5\times10^{2}$ MPa against the photosensitive member 501 to form a transfer nip b. To the transfer nip b, a transfer material P as a recording medium is supplied from a paper supply section (not shown), and a prescribed transfer bias voltage is applied to the transfer roller 505 from a voltage supply S3, whereby toner images on the photosensitive member 501 are successively transferred onto the surface of the transfer material P supplied to the transfer nip b.

In this embodiment, the transfer roller 505 had a resistivity of $5\times10^8$ ohm.cm and supplied with a DC voltage of +300 volts to perform the transfer. Thus, the transfer material P introduced to the transfer nip b is nipped and conveyed through the transfer roller 505, and on its surface, the toner images on the photosensitive member 501 surface are successively transferred under the action of an electrostatic force and a pressing force.

A fixing device 506 of, e.g., the heat fixing type is also included. The transfer material P having received a toner image from the photosensitive member 501 at the transfer nip b is separated from the photosensitive member 501 surface and introduced into the fixing device 506, where the toner image is fixed to provide an image product (print or copy) to be discharged out of the apparatus.

In the image forming apparatus of this embodiment, the cleaning unit has been removed, transfer-residual toner particles remaining on the photosensitive member 501 surface after the transfer of the toner image onto the transfer material P are not removed by such a cleaning means but, along with the rotation of the photosensitive member 501, sent via the charging section n to reach the developing section a, where they are subjected to a developing-cleaning operation to be recovered.

In the image forming apparatus of this embodiment, three process units, i.e., the photosensitive member 501, the charging roller 502 and the developing device 504 are inclusively supported to form a process-cartridge, which is detachably mountable to a main assembly of the image forming apparatus via a guide and support member. A process-cartridge may be composed of other combinations of devices.

Electroconductive fine powder m mixed in the developer 504*d* is moved together with toner particles t also in the developer 504*d* and transferred in an appropriate amount to the photosensitive member 501 at the time of developing operation of the developing device 504.

The toner image (composed of toner particles) on the photosensitive member 501 is positively transferred onto the transfer material P (recording medium) under an influence of a transfer bias voltage at the transfer section b. However, because of its electroconductivity, the electroconductive fine powder m on the photosensitive member 501 is not positively transferred to the transfer material P but substantially remains in attachment onto the photosensitive member 501.

As no cleaning unit is involved in the image forming apparatus of this embodiment, the transfer-residual toner particles and the electroconductive fine powder remaining on the photosensitive member 501 after the transfer step are, along with the rotation of the photosensitive member 501, brought to the charging section n formed at the contact part between the photosensitive member 501 and the charging roller 502 (contact charging member) to be attached to and mixed with the charging roller 502. As a result, the photosensitive member is charged by direct charge injection in the presence of the electroconductive fine powder m at the contact part n between the photosensitive member 501 and the charging roller 502.

By the presence of the electroconductive fine powder m, the intimate contact and low contact resistivity between the charging roller 502 and the photosensitive member 501 can be maintained even when the transfer-residual toner particles are attached to the charging roller 502, thereby allowing the direct injection charging of the photosensitive member 501 by the charging roller 502.

More specifically, the charging roller 502 intimately contacts the photosensitive member 501 via the electroconductive fine powder m, and the electroconductive fine powder m rubs the photosensitive member 501 surface without discontinuity. As a result, the charging of the photosensitive member 501 by the charging roller 502 is performed not relying on the discharge charging mechanism but predominantly relying on the stable and safe direct injection charging mechanism, to realize a high charging efficiency that has not been realized by conventional roller charging. As a result, a potential almost identical to the voltage applied to the charging roller 502 can be imparted to the photosensitive member 501.

The transfer-residual toner attached to the charging roller 502 is gradually discharged or released from the charging roller 502 to the photosensitive member 501, and along with the movement of the photosensitive member 501, reaches the developing section a where the toner particles are recovered to the developing device 504 in the developing-cleaning operation.

The developing-cleaning step is a step of recovering the toner particles remaining on the photosensitive member 501 after the transfer step at the time of developing operation in a subsequent cycle of image formation (developing of a latent image formed by re-charging and exposure after a previous image forming cycle operation having resulted in the transfer-residual toner particles) under the action of a fog-removing bias voltage of the developing device (Vback, i.e., a difference between a DC voltage applied to the developing device and a surface potential on the photosensitive member). In an image forming apparatus adopting a reversal development scheme adopted in this embodiment, the developing-cleaning operation is effected under the action of an electric field of recovering toner particles from a dark-potential part on the photosensitive member and an electric field of attaching toner particles from the developing sleeve and a light-potential part on the photosensitive member, respectively, exerted by the developing bias voltage.

As the image-forming apparatus is operated, the electroconductive fine powder m contained in the developer in the developing device 504 is transferred to the photosensitive member 50 surface at the developing section a, and moved via the transfer section to the charging section n along with the movement of the photosensitive member 501 surface, whereby the charging section n is successively supplied with fresh electroconductive fine powder. As a result, even when the electroconductive fine powder m is reduced by falling, etc., or the electro-conductive fine powder m at the charging section is deteriorated, the chargeability of the photosensitive member 501 at the charging section is prevented from being lowered and good chargeability of the photosensitive member 501 is stably retained.

In this way, in the image forming apparatus including a contact charging scheme, a transfer scheme and a toner recycle scheme, the photosensitive member 501 (as an image-bearing member) can be uniformly charged at a low application voltage by using a simple charging roller 502. Further, the direct injection charging of the ozonless-type can be stably retained to exhibit uniform charging performance even though the charging roller 502 is soiled with transfer-residual toner particles. As a result, it is possible to provide an inexpensive image forming apparatus of a simple structure free from difficulties, such as generation of ozone products and charging failure.

Figure 15:
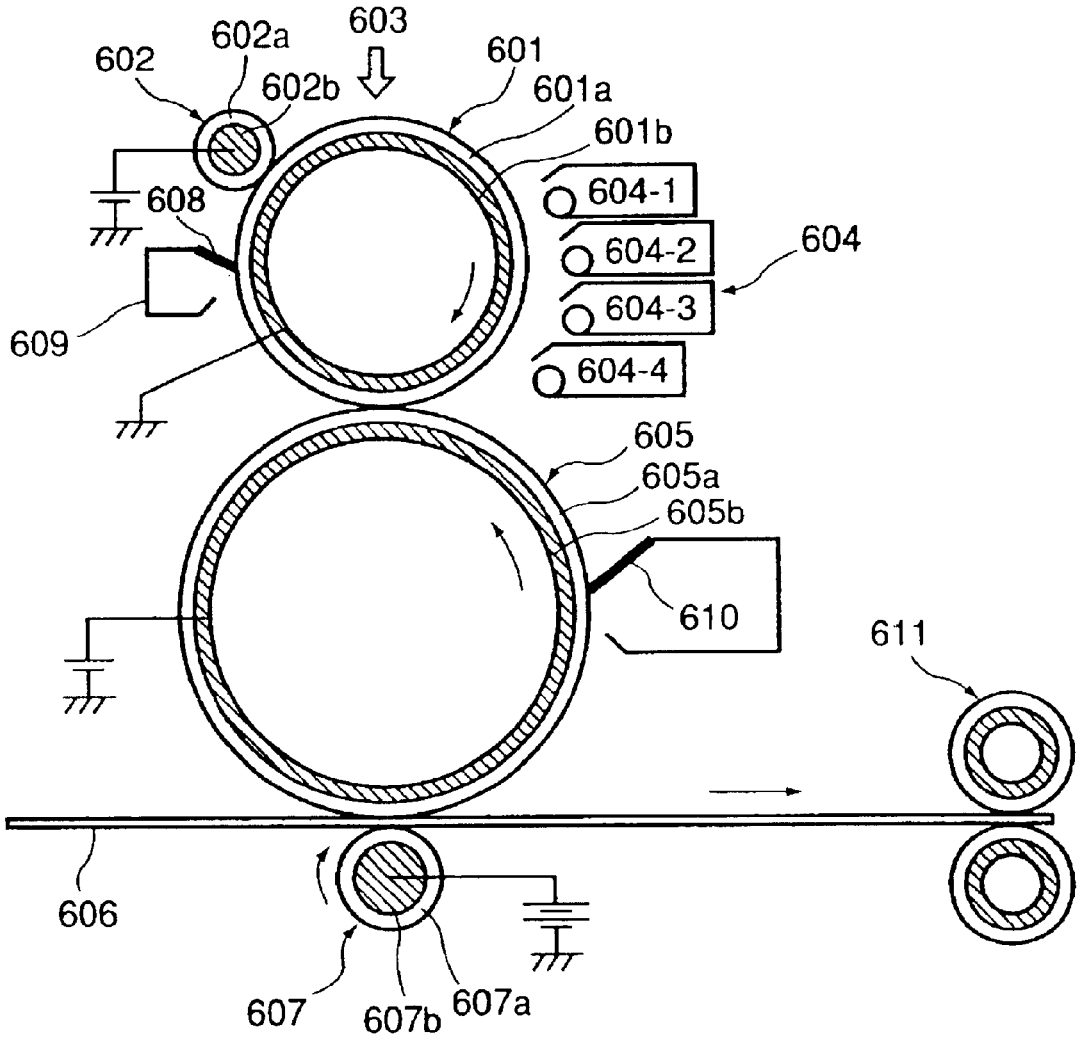

In place of the image forming apparatus shown in FIG. 14, it is also possible to use an image forming apparatus shown in FIG. 15 using an intermediate transfer member. FIG. 15 illustrates a type of image forming apparatus wherein a toner image formed on an electrostatic image-bearing member is transferred onto an intermediate transfer member, and the toner image on the intermediate transfer member is secondarily transferred onto a recording material, and this is a type of image forming apparatus preferred for a toner exhibiting a high transferability and a stable chargeability.

Referring to FIG. 15, an electrostatic image-bearing member 601 comprising a substrate 601*a* and a photosensitive layer 601*b* formed thereon and comprising an organic photoconductor is rotated in an indicated arrow direction and is charged to a surface potential of ca. −600 volts by means of a charging roller 602 comprising an electroconductive elastic layer 602*a* on a core metal 602*b* and disposed opposite to and rotated in contact with the image-bearing member 601. The charged image-bearing member (photosensitive member) 601 is then exposed to image light 603 illuminating the image-bearing member 601 by a polygonal mirror (not shown) depending on digital image data, thereby forming an electrostatic image having a light-part potential of −100 volts and a dark-part potential of −600 volts. The electrostatic image may be developed with a magenta toner, a cyan toner, a yellow toner or a black toner (which may be a magnetic toner according to the present invention) from any one of plural developing devices 604-1, 604-2, 604-3 and 604-4 in a developing unit 604 according to a reversal development scheme to form a toner image on the photosensitive member. The toner images formed successively on the photosensitive member 601 are transferred successively for respective color toners onto an intermediate transfer member 605 comprising an elastic layer 605*a* on a core metal 605*b* as a support to form 4-color superposed toner images. Transfer residual toner remaining on the photosensitive member 601 is recovered in a residual toner vessel 609 by means of a cleaner member 608.

The toner of the present invention has a high transferability, so that it can be removed even by a simple bias roller or in a system having no cleaning member.

The intermediate transfer member 605 may for example be formed by coating a support metal pipe 605*b* with an elastic layer 605*a* comprising nitrile-butadiene rubber (NBR) with electroconductive carbon black sufficiently dispersed therein. The coating layer 605*a* may have a hardness of 30 deg. (according to JIS K-6301) and a volume resistivity of 10 ohm.cm. The transfer from the photosensitive member 601 onto the intermediate transfer member 605 may be effected under a transfer current of ca. 5 $\mu$A caused by applying a voltage of +2000 volts to the metal support 605*b* from a voltage supply. The superposed toner images formed on the intermediate transfer member 605 are simultaneously transferred onto a recording material 606 under the action of a transfer roller 607 and then fixed by a fixing device 611. It is possible to clean the intermediate transfer member 605 surface by means of a cleaner member 610, as desired.

The transfer roller 607 may comprise a core metal 607 of, e.g., 20 mm, coated with an elastic layer 607 comprising a foam of ethylene-propylene-diene terpolymer (EPDM) with electroconductive carbon sufficiently dispersed therein. The elastic layer may exhibit a volume resistivity of $10^6$ ohm.cm and a hardness of 35 deg. (according to JIS K-6301). The transfer may be effected under a transfer current of 15 $\mu$A by applying a voltage to the transfer roller.

EXAMPLES

Hereinbelow, the present invention will be described more specifically based on Examples, which however should not be construed to restrict the scone of the present invention in any way. In the following Examples, "part(s)" and "%" used for describing relative amounts of components are by weight unless otherwise noted specifically.

Regarding Tables 1–3 appearing hereinafter, Table 1 shows binder resins, Table 2 shows waxes and Table 3 shows magnetic iron oxide particles respectively used in Examples described hereinafter.

Styrene-based resins (Binder resins A, B and D) were prepared by solution polymerization and a polyester resin (Binder resin C) was prepared by dehydro-condensation. Magnetic iron oxide particles were prepared in the following Production Examples.

<Magnetic Iron Oxide Particles>

Production Example 1

Into a ferrous sulfate aqueous solution, an aqueous solution of sodium hydroxide in an amount of 0.95 equivalent to $Fe^{2+}$ in the ferrous sulfate solution was added and mixed therewith to form a ferrous salt aqueous solution containing $Fe(OH)_2$. Then, sodium silicate containing 1.0 wt. % of silicon (Si) based on the iron in the ferrous salt solution was added thereto. Then, air was blown into the ferrous salt solution containing $Fe(OH)_2$ and silicon at 90° C. to cause oxidation at pH 6 to 7.5, thereby forming a suspension liquid containing silicon (Si)-containing magnetic iron oxide particles. Into the suspension liquid, an aqueous solution of hydroxide in an amount of 1.05 equivalent to $Fe^{2+}$ remaining in the slurry and containing sodium silicate including 0.1 wt. % of silicon (Si) based on the iron was added, and oxidation was continued under heating at 90° C. and at pH 8–11.5 to obtain Si-containing magnetic iron oxide particles, which were then washed, recovered by filtration and dried in an ordinary manner.

The resultant magnetic iron oxide particles contained agglomerated primary particles and therefore were disintegrated by application of compression and shearing forces by means of a treating machine ("MIX-MULLER", available from Shinto Kogyo K.K.) into primary particles having smooth surfaces, thereby obtaining Magnetic iron oxide particles (1) having properties shown in Table 3. Magnetic iron oxide particles (1) exhibited an average particle size (D1) of 0.21 μm.

Production Examples 2 to 5

Magnetic iron oxide particles (2) to (5) shown in Table 3 were respectively prepared in the same manner as in Production Example 1 except for changing the amounts of silicone (Si) as shown in Table 3, respectively.

TABLE 1

| Binder resins | | | | | | | |
|---|---|---|---|---|---|---|---|
| | Monomers | | | | | | |
| Binder resin | Species *1 | Ratio parts (or mol) | Mw ($\times 10^4$) | Mn ($\times 10^4$) | Mw/Mn (—) | Acid value (mgKOH/g) | Tg (° C.) |
| A | St | 78.0 | 30.1 | 1.1 | 27.4 | 2.2 | 59.8 |
| | nBA | 20.0 | | | | | |
| | MnBM | 1.5 | | | | | |
| | DVB | 0.5 | | | | | |
| B | St | 74.5 | 31.9 | 0.75 | 42.5 | 20 | 60.2 |
| | nBA | 20.0 | | | | | |
| | MnBM | 5 | | | | | |
| | DVB | 0.5 | | | | | |
| C | TPA | 28 (mol) | 8.5 | 0.64 | 13.3 | 9.2 | 57.8 |
| | TMA | 6 (mol) | | | | | |
| | DDSA | 16 (mol) | | | | | |
| | POBPA | 50 (mol) | | | | | |
| D | St | 79.5 | 25.5 | 0.87 | 29.0 | 0.1 | 59.4 |
| | nBA | 20.0 | | | | | |
| | DVB | 0.5 | | | | | |

*1 St = styrene,
nBA = n-butyl acrylate
MnBM = mono-n-butyl maleate,
DVB = divinylbenzene
TPA = terephthalic acid,
TMA = trimellitic anhydride
DDSA = dodecenylsuccinic acid,
POBPA = propoxy-bisphenol A

TABLE 2

| Waxes | | |
|---|---|---|
| Wax | species | $T_{abs\text{-}max}$ (° C.) |
| (a) | polypropylene | 140 |
| (b) | polyethylene | 80 |
| (c) | paraffin | 73 |
| (d) | Fischer-Tropsche | 110 |

TABLE 3

| Magnetic iron oxide particles | D1 (μm) | Si content (%) | $S_{BET}$ ($m^2/g$) |
|---|---|---|---|
| (1) | 0.21 | 1.09 | 10.0 |
| (2) | 0.21 | 0.80 | 9.7 |
| (3) | 0.21 | 0.25 | 10.3 |
| (4) | 0.20 | 2.40 | 15.1 |
| (5) | 0.21 | 1.80 | 14.2 |

Example 1

<Toner Preparation>

| | |
|---|---|
| Binder resin B | 100 parts |
| Magnetic iron oxide particles (1) | 90 " |
| Wax (c) | 4 " |
| Azo iron complex (1) ($A^+ = NH_4^+$) (mentioned before) | 2 " |

The above ingredients were pre-blended in a Henschel mixer and melt-kneaded by a twin-screw extruder at 130° C. The melt-kneaded product was coarsely crushed to below 1 mm by a cutter mill.

The thus-formed coarsely crushed material (as a powdery feed) were supplied to a mechanical pulverizer 301 (as shown in FIGS. 2 and 3) for pulverization, and the pulverized material was classified by a multi-division classifier 1 (FIGS. 2 and 6) to recover a medium powder fraction having a weight-average particle size (D4) of 6.8 μm. The medium powder fraction was further surface-treated by passing it through a surface treatment apparatus shown in FIGS. 10–13 for continuously applying a mechanical impact force thereto to obtain Toner particles (1).

For the above operation, the pulverization surfaces of the rotor 314 and the stator 310 of the mechanical pulverizer 301 had been roughened to have a central roughness (Ra) of 5.9 μm, a maximum roughness (Ry) of 23.4 μm and a ten point-average roughness (Rz) of 21.4 μm, and nitrided as an anti-wearing treatment. The rotor 314 was disposed with a gap of 1.3 mm from the stator 310 and rotated at a circumferential speed of 117 m/s. The inlet temperature T1 was −10° C. and the outlet temperature T2 was 42° C. As for the surface treatment conditions, the rotors 402*a*–402*d* were rotated at a circumferential speed of 40 m/s, and the medium powder fraction was supplied at a rate of 20 kg/hour through the auto-feeder 415 while operating the blower 424 at a suction air rate of 3.0 $m^3$/min. to effect the surface treatment for 1 hour. The powdery feed was caused to pass through the apparatus within ca. 20 sec. The exhaust air stream temperature was 49° C.

100 wt. parts of Toner particles (1) thus prepared were externally blended with 1.2 wt. parts of negatively chargeable hydrophobic silica ($S_{BET}$=120 $m^2$/g, a methanol wettability ($W_{MeOH}$) of 80%) obtained after hydrophobization with 15 wt. % of hexamethyldisilazane and 15 wt. % of dimethylsilicone, 1.0 wt. parts of strontium titanate and 2.0 wt. parts of aluminum-containing zinc oxide powder having a resistivity of 100 ohm.cm (as electroconductive fine powder) to obtain Toner No. 1.

Figure 16:
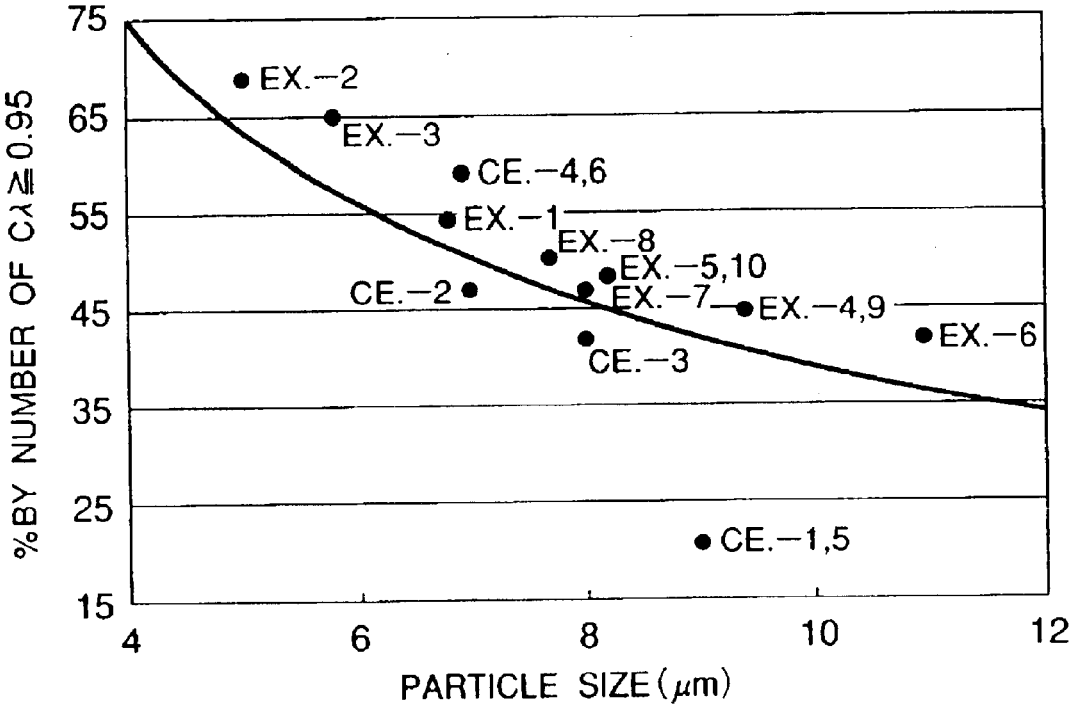
FIG. 16 is a graph showing a relationship between an average particle size and a circularity.
Figure 17:
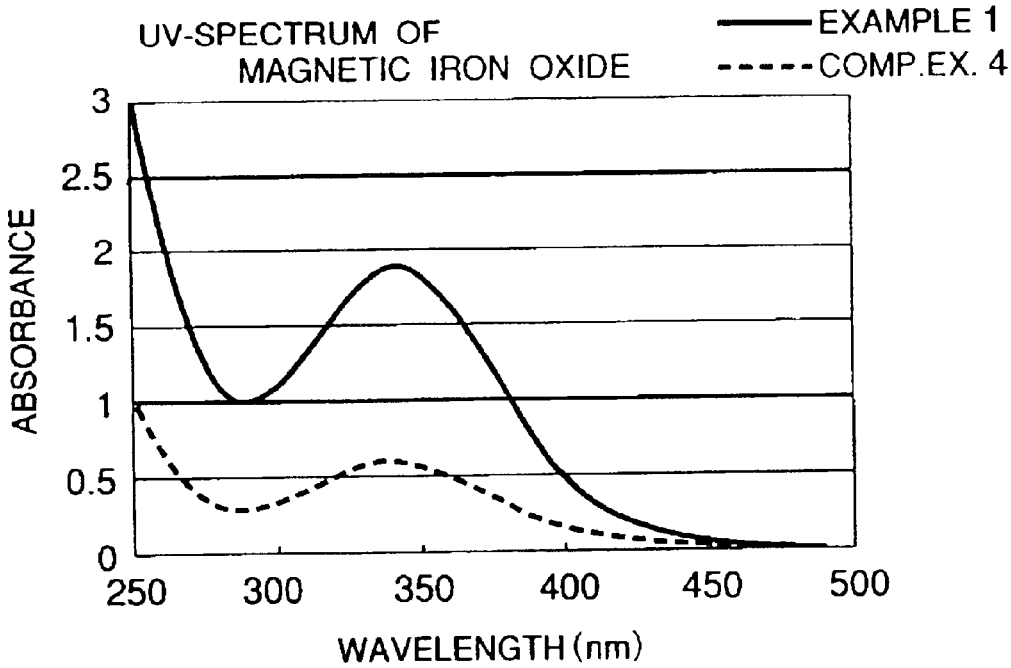
FIG. 17 is a graph showing two types of UV-absorption spectra of solutions of magnetic iron oxide extracted from toner particle surfaces.

According to the measurement by "FPIA-2100", Toner No. 1 exhibited a number-basis circularity distribution as shown in Table 4 below, wherein the upper limit of each range of Ci is not included, and no particles were found in lower circularity ranges of 0.40–0.57. Toner prescriptions, pulverization conditions, surface-treatment conditions and some physical properties of toner No. 1 are summarized in Table 5 together with those of Toner Nos. 2–16 prepared in Examples and Comparative Examples described hereinafter. A spot showing a relationship between % by number of particles of Ci (circularity)≧0.950 (=Y) and weight-average particle size (D4=X) is shown in FIG. 16 together with those of other toners, and a UV-spectrum representing a degree of surface-exposed magnetic iron oxide of Toner No. 1 is shown in FIG. 17 together with that of Toner No. 11 (prepared in Comparative Example 1 described hereinafter).

TABLE 4

Circularity (Ci) distribution of Toner No. 1 (Example 1)

| Range of Ci | Distribution: cumulative (%) | in each range (%) | number of particles |
|---|---|---|---|
| 1.00 | 1.47 | 1.47 | 62 |
| 0.99–1.00 | 5.99 | 4.52 | 190 |
| 0.98–0.99 | 15.70 | 9.71 | 408 |
| 0.97–0.98 | 29.33 | 13.63 | 573 |
| 0.96–0.97 | 45.43 | 16.1 | 677 |
| 0.95–0.96 | 58.89 | 13.46 | 566 |
| 0.94–0.95 | 69.88 | 10.99 | 462 |
| 0.93–0.94 | 78.30 | 8.42 | 354 |
| 0.92–0.93 | 84.03 | 5.73 | 241 |
| 0.91–0.92 | 88.53 | 4.50 | 189 |
| 0.90–0.91 | 90.60 | 2.07 | 87 |
| 0.89–0.90 | 92.72 | 2.12 | 89 |
| 0.88–0.89 | 93.96 | 1.24 | 52 |
| 0.87–0.88 | 94.89 | 0.93 | 39 |
| 0.86–0.87 | 95.65 | 0.76 | 32 |
| 0.85–0.86 | 96.24 | 0.59 | 25 |
| 0.84–0.85 | 96.86 | 0.62 | 26 |
| 0.83–0.84 | 97.53 | 0.67 | 28 |
| 0.82–0.83 | 97.93 | 0.40 | 17 |
| 0.81–0.82 | 98.33 | 0.40 | 17 |
| 0.80–0.81 | 98.76 | 0.43 | 18 |
| 0.79–0.80 | 99.07 | 0.31 | 13 |
| 0.78–0.79 | 99.26 | 0.19 | 8 |
| 0.77–0.78 | 99.36 | 0.10 | 4 |
| 0.76–0.77 | 99.53 | 0.17 | 7 |
| 0.75–0.76 | 99.65 | 0.12 | 5 |
| 0.74–0.75 | 99.70 | 0.05 | 2 |
| 0.73–0.74 | 99.82 | 0.12 | 5 |
| 0.72–0.73 | 99.89 | 0.07 | 3 |
| 0.71–0.72 | 99.96 | 0.07 | 3 |
| 0.70–0.71 | 99.98 | 0.02 | 1 |
| 0.69–0.70 | 99.98 | 0 | 0 |
| 0.68–0.69 | 99.98 | 0 | 0 |
| 0.67–0.68 | 99.98 | 0 | 0 |
| 0.66–0.67 | 99.98 | 0 | 0 |
| 0.65–0.66 | 99.98 | 0 | 0 |
| 0.64–0.65 | 99.98 | 0 | 0 |
| 0.63–0.64 | 99.98 | 0 | 0 |
| 0.62–0.63 | 99.98 | 0 | 0 |
| 0.61–0.62 | 99.98 | 0 | 0 |
| 0.60–0.61 | 99.98 | 0 | 0 |
| 0.59–0.60 | 99.98 | 0 | 0 |
| 0.58–0.59 | 99.98 | 0 | 0 |
| 0.57–0.58 | 100 | 0.02 | 1 |

TABLE 5

| Example | 1 | 2 | 3 | 4 | 5 | 6 | 7 | 8 | 9 | 10 | Comp. 1 | Comp. 2 | Comp. 3 | Comp. 4 | Comp. 5 | Comp. 6 |
|---|---|---|---|---|---|---|---|---|---|---|---|---|---|---|---|---|
| Toner No. | 1 | 2 | 3 | 4 | 5 | 6 | 7 | 8 | 9 | 10 | 11 | 12 | 13 | 14 | 15 | 16 |
| Binder resin | B | C | B | A | D | C | A | B | A | D | A | B | D | B | A | B |
| Charge control agent | 1 | 13 | 1 | 9 | 9 | 13 | 1 | 1 | 9 | 9 | 9 | 1 | 9 | 13 | 9 | 13 |
| Wax | c | b | c | a | d | b | c | e | a | d | a | c | d | a | a | a |
| Magnetic iron oxide | 1 | 1 | 2 | 3 | 2 | 1 | 2 | 1 | 3 | 2 | 4 | 2 | 3 | 5 | 4 | 5 |
| <Pulverization conditions> (FIG. 3) | | | | | | | | | | | | | | | | |
| Inlet temp. T1 (° C.) | −10 | −10 | −10 | −10 | −10 | −10 | −10 | −10 | −10 | −10 | FIG. 7 | | −10 | −10 | FIG. 7 | −10 |
| Outlet temp. T2 (° C.) | 42 | 37 | 45 | 63 | 30 | 40 | 45 | 42 | 63 | 30 | | | 42 | 60 | | 60 |
| ΔT = (T2-T1) | 52 | 47 | 55 | 73 | 40 | 50 | 55 | 52 | 73 | 40 | | | 52 | 70 | | 70 |
| Rotor speed (m/sec) | 117 | 125 | 114 | 150 | 90 | 115 | 130 | 125 | 150 | 90 | | | 120 | 145 | | 145 |
| <Surface treatment conditions> (FIG. 11 or hot air) | | | | | | | | | | | | | | hot air | | hot air |
| Exhaust air temp. T3 (° C.) | 49 | 55 | 53 | 72 | 35 | 48 | 37 | 40 | 72 | 35 | | 45 | | 300° C. | | 300° C. |
| Tg-T3 (° C.) | 11.2 | 2.8 | 7.2 | 12.2 | 24.4 | 9.8 | 12.8 | 20.2 | 12.2 | 24.4 | | 15.2 | | −239.8 | | −239.8 |
| Wax Tmp-T3 (° C.) | 24 | 25 | 20 | 68 | 75 | 32 | 36 | 60 | 68 | 75 | | 18 | | −160 | | −160 |
| Tg (toner) ° C. | 60.1 | 58.0 | 60.3 | 59.6 | 59.0 | 58.1 | 59.6 | 59.9 | 59.6 | 59.0 | 60.0 | 60.3 | 59.2 | 60.2 | 60.0 | 60.2 |
| <External additive (wt. parts)> | | | | | | | | | | | | | | | | |
| silica | 1.2 | 1.2 | 1.0 | 1.2 | 1.2 | 1.0 | 1.0 | 1.0 | 1.2 | 1.2 | 1.2 | 1.2 | 1.2 | 1.2 | 1.2 | 1.2 |
| strontium titanate | 1.0 | 0.8 | 2.0 | 0.8 | 2.4 | 2.4 | 0.4 | 0.6 | 0.8 | 2.4 | 0.4 | 2.0 | 1.0 | 1.0 | 0.4 | 1.0 |
| conductor powder | 2.0 | 2.0 | 2.0 | 2.0 | 2.0 | 2.0 | 1.0* | 1.0* | — | — | 2.0 | 2.0 | 2.0 | 2.0 | — | — |
| D4 (=X) (μm) | 6.8 | 5.0 | 5.8 | 9.4 | 8.2 | 11.0 | 8.0 | 7.7 | 9.4 | 8.2 | 9.0 | 7.0 | 8.0 | 6.9 | 9.0 | 6.9 |
| Ci ≧ 0.900 (%) | 88.5 | 89.9 | 92.0 | 89.7 | 91.2 | 90.3 | 87.5 | 88.2 | 90.0 | 91.4 | 75.7 | 90.0 | 89.5 | 91.6 | 75.8 | 91.7 |
| Ci ≧ 0.950 (=Y) (%) | 58.9 | 69.2 | 65.1 | 44.6 | 48.3 | 41.8 | 47.2 | 50.3 | 44.7 | 48.7 | 20.9 | 47.2 | 41.9 | 59.2 | 20.9 | 59.4 |
| $X^{-0.715}$ × exp 5.31 | 51.4 | 64.0 | 57.6 | 40.8 | 44.9 | 36.4 | 45.7 | 47.0 | 40.8 | 44.9 | 42.0 | 50.3 | 45.8 | 50.8 | 41.9 | 50.8 |
| UV absorbance at 340 nm | 1.9 | 1.8 | 1.6 | 1.4 | 2.2 | 1.9 | 1.2 | 2.4 | 1.4 | 2.2 | 2.8 | 1.8 | 2.2 | 0.6 | 2.8 | 0.6 |

*Toner Nos. 7 and 8 contained tin oxide fine powder of 130 Ω · cm.

<Performance Evaluation>

Example 1

Toner No. 1 prepared above was incorporated in a process cartridge of an image forming apparatus having an organization as shown in FIG. 14 obtained by re-modeling a commercially available laser beam printer ("LBP-250", made by Canon K.K.) so as to include a cleanerless image forming system as described with reference to FIG. 14. Image-forming performances of Toner No. 1 were evaluated by printing on 5000 sheets while replenishing the toner, as required, in each of low temperature/low humidity environment (15° C./10% RH), normal temperature/normal humidity environment (23.5° C./60% RH) and high temperature/high humidity environment (30° C./80% RH). The evaluation was performed with respect to the following items.

Image density (ID) was measured in terms of a reflection density with respect to a 5 mm-square solid image by means of a Macbeth densitometer (available from Macbeth Co.) with an SPI filter.

Fog was determined by measuring a highest reflection density Ds of a white background portion of a printed image on a white transfer paper and also an average reflection density Dr of the white transfer paper before the printing to determine a difference Ds−Dr as a value of fog. A lower fog value represents a better fog suppression state.

Dot reproducibility (Dot) was evaluated as an item of image quality evaluation in terms of number of reproduced lack-free dots among reproduced 100 discrete dots. A larger number represents a higher image quality.

The measurement of the above items was performed at the initial stage and after printing on 5000 sheets in the continuous printing test, and after standing outside the printer for 1 day after the continuous printing test, in each environment.

Toner attachment was evaluated after the above printing test in the low temperature/low humidity environment by observing the degree of toner attachment onto the charging member according to the following standard:

| | |
|---|---|
| A: | No attachment observed. |
| B: | Slight attachment observed. |
| C: | Noticeable attachment was observed in such a degree as to result in an image irregularity in halftone images. |

The results are inclusively shown in Tables 6, 7 and 8 together with those of Examples and Comparative Examples described hereinafter.

Separately, Toner No. 1 was incorporated in another commercially laser beam printer having a hot roller fixing device ("LBP-950", made by Canon K.K.) after re-modeling of taking out the hot roller fixing device to provide an external fixing device capable of arbitrarily setting fixation temperatures and operable at a process speed of 235 mm/sec to evaluate the fixability and anti-offset characteristic in the following manner.

Fixability was evaluated by passing a solid black toner image carried on plain paper through the fixing device temperature-controlled at 150° C., which was then rubbed for 5 reciprocations with lens-cleaning paper under a load of $0.49\times10^{-2}$ MPa. The fixability was evaluated based on the percentage of image density lowering after the rubbing according to the following standard:

| | |
|---|---|
| A: | <10%. |
| B: | ≧10% and <20%. |
| C: | ≧20%. |

Anti-offset

A sample image having an image areal percentage of 5% was printed out on 5000 sheets and the printed images were fixed through the fixing device. A fixed image after the printing on 3000 sheet was evaluated with respect to soiling on the image according to the following standard:

| | |
|---|---|
| A: | No soiling observed. |
| B: | Slight soiling observed. |
| C: | Noticeable soiling affecting the image was observed. |

A commercially available laser beam printer ("LBP-950", made by Canon K.K.) without the above re-modeling was used for the following test.

Transfer efficiency (%) was measured at an initial stage (Ti) and after printing on 10,000 sheets (Tf) in the normal temperature/normal humidity environment. For printing, plain paper of 75 g/m$^2$ was used as transfer paper. For the evaluation of transfer rate, a toner image on the OPC photosensitive member before the transfer and a transfer residual toner were respectively peeled off by polyester adhesive tapes and applied onto white paper to measure Macbeth densities Di and Dr. Separately, the polyester adhesive tape in a blank state was applied onto the white paper to measure a Macbeth density Do. The transfer efficiency was calculated according to the following formula:

$$\text{Transfer efficiency } (Ti \text{ or } Tf)(\%)=((Di-Dr)/(Di-D_0))\times100.$$

Pattern recovery was evaluated in the low temperature/low humidity environment by continuously printing an identical pattern of vertical lines (repetition of 2 dots and a space of 98 dot size) on 10000 sheets and then printing a halftone image (repetition of lateral lines of 2 dots and a space of 3 dot size). The pattern recovery performance was evaluated by observing whether or not a density difference corresponding to the vertical lines appeared on the halftone image according to the following standard:

| | |
|---|---|
| A: | No density difference. |
| B: | Slight density difference. |

-continued

| | |
|---|---|
| C: | Noticeable density difference on the halftone image. |

The results of the above evaluation items by using the laser beam printers ("LBP-950", after and without the re-modeling) are inclusively shown in Table 9 together with those of Examples and Comparative Examples described hereinbelow.

Example 2

Toner No. 2 was prepared and evaluated in the same manner as in Example 1 except for using the toner prescription (including the composition for providing toner particles and the external additives) shown in Table 5 (appearing hereinbefore) and changing the rotor peripheral speed of the pulverizer to 125 m/sec. The pulverizer inlet temperature T1 was −10° C., the pulverizer outlet temperature T2 was 37° C., and the exhaust air temperature T3 from the surface-treatment apparatus was 55° C.

The toner prescription, pulverization conditions, surface treatment conditions and some physical properties are shown in Table 5, a spot showing a relationship of Y (=% by number of particles of Ci≧950) and X (=weight-average particle size (D4)) is shown in FIG. 16, and the results of toner performance evaluation are shown in Tables 6–9, respectively together with those of the toner of Example 1 and toners of Examples and Comparative Examples described hereinafter.

Example 3

Toner No. 3 was prepared and evaluated in the same manner as in Example 1 except for using the toner prescription shown in Table 5 and setting the pulverizer rotor peripheral speed to 114 m/sec. The inlet temperature T1 was −10° C., the outlet temperature T2 was 45° C. and the exhaust air temperature T3 was 53° C.

Example 4

Toner No. 4 was prepared and evaluated in the same manner as in Example 1 except for using the toner prescription shown in Table 5 and setting the pulverizer rotor peripheral speed to 150 m/sec. The inlet temperature T1 was −10° C., the outlet temperature T2 was 63° C. and the exhaust air temperature T3 was 72° C.

Example 5

Toner No. 5 was prepared and evaluated in the same manner as in Example 1 except for using the toner prescription shown in Table 5 and setting the pulverizer rotor peripheral speed to 90 m/sec. The inlet temperature T1 was −10° C., the outlet temperature T2 was 30° C. and the exhaust air temperature T3 was 35° C.

Example 6

Toner No. 6 was prepared and evaluated in the same manner as in Example 1 except for using the toner prescription shown in Table 5 and setting the pulverizer rotor peripheral speed to 115 m/sec. The inlet temperature T1 was −10° C., the outlet temperature T2 was 40° C. and the exhaust air temperature T3 was 40° C.

Example 7

Toner No. 7 was prepared and evaluated in the same manner as in Example 1 except for using the toner prescription shown in Table 5 and setting the pulverizer rotor peripheral speed to 130 m/sec. The inlet temperature T1 was −10° C., the outlet temperature T2 was 45° C. and the exhaust air temperature T3 was 37° C.

Example 8

Toner No. 8 was prepared and evaluated in the same manner as in Example 1 except for using the toner prescription shown in Table 5 and setting the pulverizer rotor peripheral speed to 125 m/sec. The inlet temperature T1 was −10° C., the outlet temperature T2 was 42° C. and the exhaust air temperature T3 was 40° C.

Comparative Example 1

Figure 8:
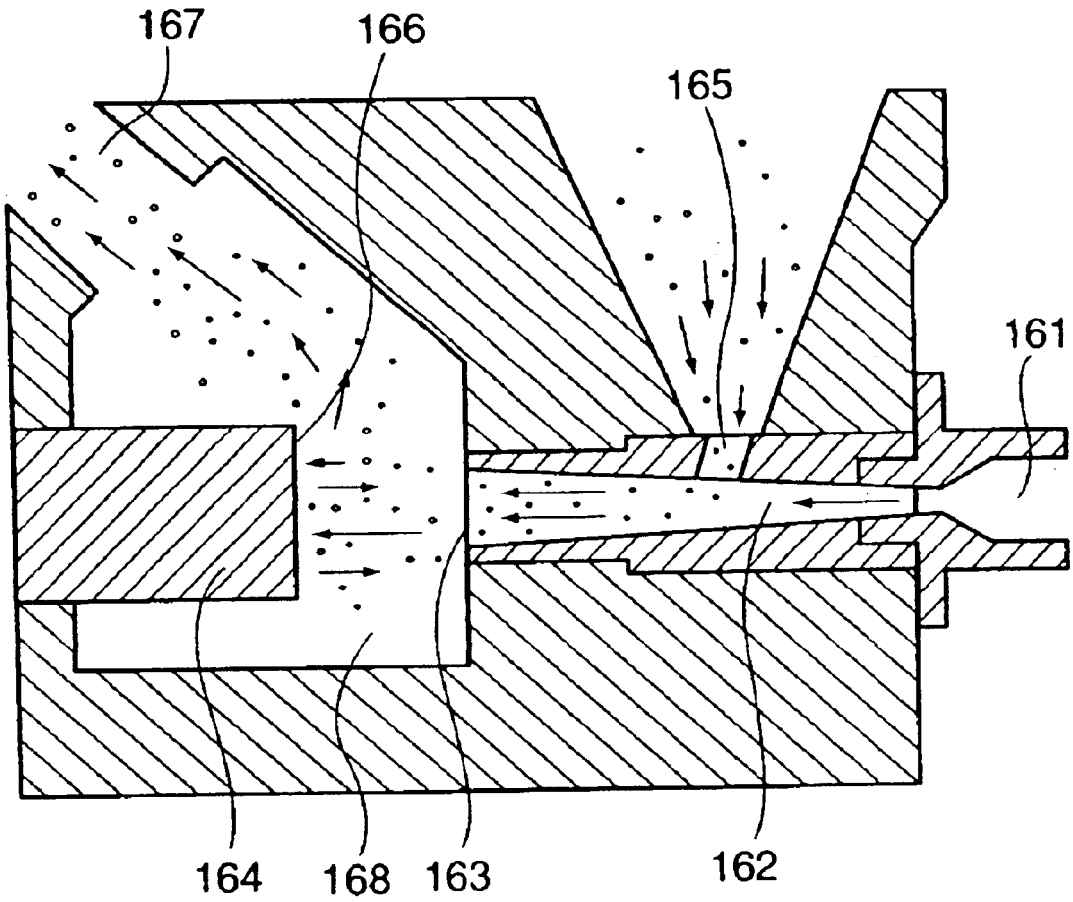
FIG. 8 is a schematic sectional view of a conventional impingement-type pneumatic pulverizer.
Figure 9:
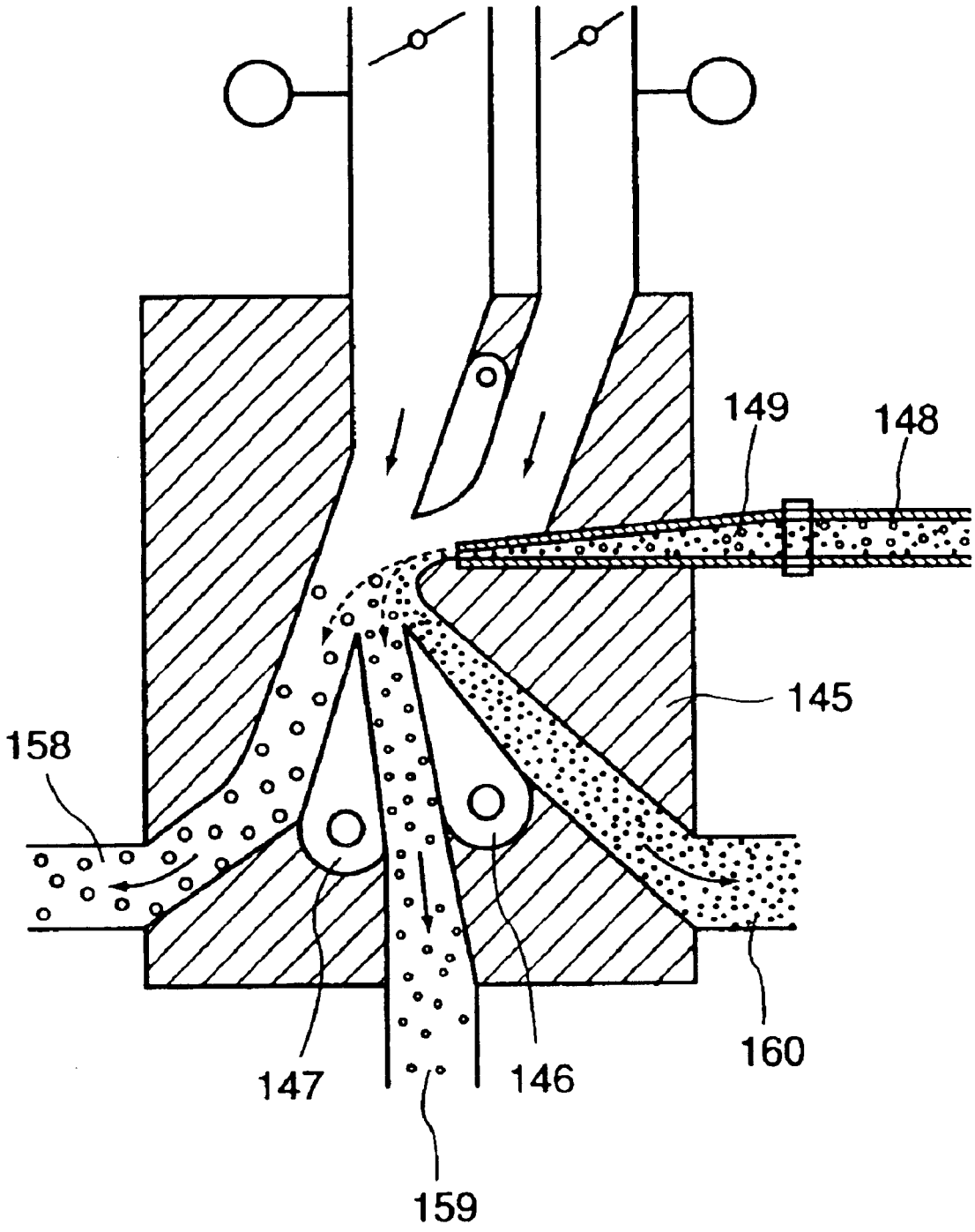
FIG. 9 is a schematic sectional view of a multi-division pneumatic classifier conventionally used as a second classification means.

Toner particles (11) were prepared from starting materials shown in Table 5. The coarsely crushed material was processed in a system as shown in FIG. 7, i.e., pulverized by an impingement-type pneumatic pulverizer having an organization shown in FIG. 8, and the pulverizate was subjected to a first classification and the fine powder was further classified by a multi-division classifier similarly as in Example 1. The medium powder faction was recovered as Toner particles (11) without surface treatment.

100 wt. parts of Toner particles (11) were blended with 1.2 wt. parts of the hydrophobic silica fine powder, 0.4 wt. part of the strontium titanate and 2.0 wt. parts of the aluminum-containing zinc oxide electroconductive fine powder, respectively used in Example 1, to obtain Toner No. 11.

Toner No. 11 thus-obtained was evaluated in the same manner as in Example 1.

Comparative Example 2

Toner No. 12 was prepared and evaluated in the same manner as in Comparative Example 1 except for using the toner prescription shown in Table 5 and surface-treating the classified medium powder in a similar manner as in Example 1. The exhaust air temperature T3 from the apparatus was 45° C.

Comparative Example 3

Toner No. 13 was prepared and evaluated in the same manner as in Example 1 except for using the toner prescription shown in Table 5, setting the pulverizer rotor peripheral speed to 120 m/sec. and not effecting the surface treatment of the classified medium powder. The inlet temperature T1 was −10° C. and the outlet temperature T2 was 42° C.

Comparative Example 4

Toner No. 14 was prepared and evaluated in the same manner as in Example 1 except for using the toner prescription shown in Table 5, setting the pulverizer rotor peripheral speed to 145 m/sec. and subjecting the medium powder from the classifier to an instantaneous surface-treatment with hot air at 300° C. instead of using the apparatus shown in FIGS. 10–13. The inlet temperature T1 was −10° C. and the outlet temperature T2 was 60° C.

Example 9

Toner No. 9 was prepared in the same manner as Toner No. 4 prepared in Example 4 except for omitting the electroconductive fine powder of aluminum-containing zinc oxide from the external additives.

Toner No. 9 was subjected to a continuous printing test on 10000 sheets in each of the low temperature/low humidity, normal temperature/normal humidity and high temperature/high humidity environments, by using a commercially available laser beam printer ("LBP-2160", made by Canon K.K.).

The image-forming performances were evaluated with respect to Image density (ID), Foq and Dot-reproducibility (Dot) in similar manners as in Example 1.

Toner No. 9 was further evaluated by using the laser beam printer ("LBP-2160") with respect to the following items.

Transferability

Three 5 mm-square spots (toner weight of 0.8 mg/cm$^2$) were printed on a line 30 mm distant from the upper edge and at three points which were at 30 mm from the left side, the center and 30 mm from the right side, respectively, of a vertically disposed A4-size plain paper (of 90 g/m$^2$). An adhesive tape was applied onto each of the three spots to measure reflection densities, from which an average density D1 was desired. Separately, transfer residual toner images at the three spots were peeled apart from the photosensitive member and applied on the transfer paper to measure reflection densities, from which an average density D2 was derived.

Transfer rate (Tr) (%) was calculated according to the following formula:

$$\text{Transfer rate } (Tr)(\%)=[D1/(D1+D2)]\times 100.$$

The above transferability measurement was performed at 10 different transfer bias current levels of 2, 4, 6, 8, 10, 12, 14, 16, 18 and 20 $\mu$A. Then, the transferability was evaluated based on the number of transfer bias current levels allowing a transfer rate of 90% or higher (Tr≧90%) according to the following standard:

| | |
|---|---|
| A: | Tr ≧ 90% at 7 or more levels. |
| B: | Tr ≧ 90% at 5–6 levels. |
| C: | Tr ≧ 90% at 2–4 levels. |
| D: | Tr ≧ 90% at 1 or 0 level. |

Soiling and Cleanability on the Photosensitive Member

The printer was operated without feeding recording papers (and without abutting the transfer roller to the photosensitive member) while supplying the toner at a constant rate of 2.5 g/1000 A4-size sheets from the developing device to the photosensitive member for a period corresponding to continuous printing on 20,000 sheets. The soiling (i) and cleanability (ii) on the photosensitive member were evaluated by observing the surface of the photosensitive member with eyes by interrupting the printing energy after printing on 1000 sheets and taking out the process cartridge with respect to the presence or absence of (i) melt-stuck toner and (ii) streak-like soiling, respectively, on the photosensitive member and evaluated according to the following standards:

| | |
|---|---|
| A: | No melt-stuck toner or streak soiling observed after printing on 20000 sheets. |
| B: | Melt-stuck toner or streak soiling observed after printing on 15000 or more sheets. |
| C: | Melt-stuck toner or streak soiling observed after printing on 10000 to 15000 sheets. |
| D: | Melt-stuck toner or streak soiling observed after printing on less than 10000 sheets. |

Incidentally, a toner supply rate of 2.5 g/1000 A4-size sheet is a much lower level of supply rate than in an ordinary image formation and corresponds to a transfer residual toner amount remaining after transfer at a transfer efficiency of 95%.

Toner No. 9 was further evaluated with respect to Fixability and Anti-offset characteristic in the same manner as in Example 1 by using the re-modeled laser beam printer ("LBP-950" after re-modeling).

The results of the above evaluation are inclusively shown in Tables 10–13 together with those of toners prepared in the following Examples and Comparative Examples.

Example 10

Toner No. 10 was prepared in the same manner as Toner No. 5 prepared in Example 5 except for omitting the electroconductive fine powder of aluminum-containing zinc oxide, and was evaluated in the same manner as in Example 9.

Comparative Example 5

Toner No. 15 was prepared in the same manner as Toner No. 11 prepared in Comparative Example 1 except for omitting the electroconductive fine powder of aluminum-containing zinc oxide, and was evaluated in the same manner as in Example 9.

Comparative Example 6

Toner No. 16 was prepared in the same manner as Toner No. 14 prepared in Comparative Example 4 except for omitting the electroconductive fine powder of aluminum-containing zinc oxide, and was evaluated in the same manner as in Example 9.

TABLE 6

| HT/HH (30° C./80% RH) | | | | | | | | |
|---|---|---|---|---|---|---|---|---|
| | Initial | | | After 5000 sheets | | | After standing for 1 day | |
| Example | I.D. | Fog | Dot | I.D. | Fog | Dot | I.D. | Fog |
| 1 | 1.50 | 0.5 | 100 | 1.49 | 0.5 | 100 | 1.48 | 0.6 |
| 2 | 1.45 | 0.7 | 98 | 1.42 | 0.9 | 96 | 1.40 | 0.9 |
| 3 | 1.47 | 0.8 | 99 | 1.47 | 0.9 | 97 | 1.45 | 0.8 |
| 4 | 1.48 | 0.9 | 99 | 1.46 | 0.8 | 97 | 1.40 | 0.9 |

TABLE 6-continued

| HT/HH (30° C./80% RH) | | | | | | | | |
|---|---|---|---|---|---|---|---|---|
| | Initial | | | After 5000 sheets | | | After standing for 1 day | |
| Example | I.D. | Fog | Dot | I.D. | Fog | Dot | I.D. | Fog |
| 5 | 1.44 | 1.1 | 100 | 1.42 | 1.2 | 99 | 1.41 | 1.1 |
| 6 | 1.46 | 1.5 | 96 | 1.44 | 1.7 | 95 | 1.42 | 1.6 |
| 7 | 1.43 | 1.2 | 95 | 1.39 | 1.5 | 91 | 1.38 | 1.5 |
| 8 | 1.45 | 1.8 | 100 | 1.44 | 2.1 | 98 | 1.42 | 2.1 |
| Comp. 1 | 1.39 | 1.1 | 95 | 1.35 | 1.3 | 90 | 1.30 | 1.2 |
| Comp. 2 | 1.44 | 0.8 | 91 | 1.41 | 1.0 | 90 | 1.39 | 1.0 |
| Comp. 3 | 1.39 | 0.8 | 93 | 1.38 | 0.9 | 90 | 1.37 | 0.9 |
| Comp. 4 | 1.20 | 1.5 | 87 | 1.10 | 2.3 | 80 | 1.05 | 2.2 |

TABLE 7

| NT/NH (23.5° C./60% RH) | | | | | | | | |
|---|---|---|---|---|---|---|---|---|
| | Initial | | | After 5000 sheets | | | After standing for 1 day | |
| Example | I.D. | Fog | Dot | I.D. | Fog | Dot | I.D. | Fog |
| 1 | 1.48 | 0.6 | 100 | 1.46 | 0.8 | 99 | 1.45 | 0.8 |
| 2 | 1.46 | 1.0 | 100 | 1.45 | 1.2 | 98 | 1.44 | 1.1 |
| 3 | 1.45 | 1.3 | 100 | 1.42 | 1.3 | 99 | 1.42 | 1.3 |
| 4 | 1.47 | 1.5 | 100 | 1.44 | 1.4 | 99 | 1.41 | 1.5 |
| 5 | 1.45 | 1.1 | 99 | 1.44 | 1.2 | 97 | 1.43 | 1.1 |
| 6 | 1.48 | 0.5 | 100 | 1.47 | 0.9 | 97 | 1.45 | 1.2 |
| 7 | 1.44 | 1.3 | 98 | 1.41 | 1.6 | 96 | 1.40 | 1.8 |
| 8 | 1.46 | 1.7 | 100 | 1.42 | 2.0 | 99 | 1.42 | 1.6 |
| Comp. 1 | 1.42 | 1.5 | 95 | 1.40 | 1.8 | 91 | 1.38 | 2.2 |
| Comp. 2 | 1.44 | 0.9 | 96 | 1.40 | 1.9 | 92 | 1.37 | 1.8 |
| Comp. 3 | 1.41 | 1.0 | 94 | 1.38 | 2.1 | 89 | 1.35 | 2.3 |
| Comp. 4 | 1.30 | 2.0 | 88 | 1.25 | 2.8 | 84 | 1.23 | 2.7 |

TABLE 8

| LT/LH (15° C./10% RH) | | | | | | | | | |
|---|---|---|---|---|---|---|---|---|---|
| | Initial | | | After 5000 sheets | | | After standing for 1 day | | Toner |
| Example | I.D. | Fog | Dot | I.D. | Fog | Dot | I.D. | Fog | attachment |
| 1 | 1.47 | 0.6 | 100 | 1.46 | 0.7 | 99 | 1.46 | 0.7 | A |
| 2 | 1.45 | 1.2 | 98 | 1.45 | 2.0 | 97 | 1.45 | 1.9 | A |
| 3 | 1.46 | 1.4 | 100 | 1.44 | 1.9 | 98 | 1.43 | 1.9 | A |
| 4 | 1.48 | 1.8 | 100 | 1.46 | 2.1 | 99 | 1.45 | 2.1 | A |
| 5 | 1.44 | 1.3 | 99 | 1.42 | 1.9 | 96 | 1.41 | 1.8 | B |
| 6 | 1.47 | 0.9 | 100 | 1.45 | 1.5 | 97 | 1.45 | 1.4 | A |
| 7 | 1.45 | 1.4 | 94 | 1.40 | 1.8 | 90 | 1.38 | 1.8 | B |
| 8 | 1.47 | 1.9 | 99 | 1.46 | 2.1 | 97 | 1.45 | 2.1 | A |
| Comp. 1 | 1.39 | 1.8 | 91 | 1.35 | 2.3 | 90 | 1.33 | 2.2 | C |
| Comp. 2 | 1.43 | 1.0 | 95 | 1.41 | 1.3 | 94 | 1.41 | 1.5 | B |
| Comp. 3 | 1.4 | 1.2 | 93 | 1.40 | 1.5 | 91 | 1.39 | 1.5 | B |
| Comp. 4 | 1.15 | 2.3 | 85 | 1.10 | 3.1 | 83 | 1.10 | 3.0 | A |

TABLE 9

| Fixability and Transfer efficiency | | | | | | |
|---|---|---|---|---|---|---|
| | | | Transfer efficiency (%) | | | |
| Example | Fixability | Anti-offset | initial: Ti | after 10000 sheets: Tf | Ti–Tf | Pattern recovery |
| 1 | A | A | 93.6 | 91.1 | 2.5 | A |
| 2 | A | A | 94.1 | 92.3 | 1.8 | A |
| 3 | A | A | 93.9 | 90.9 | 3.0 | A |
| 4 | B | A | 93.8 | 91.2 | 2.6 | A |
| 5 | A | A | 92.8 | 89.6 | 3.2 | B |
| 6 | A | A | 94.5 | 92.5 | 2.0 | A |
| 7 | A | A | 93.2 | 90.1 | 3.1 | A |
| 8 | A | A | 91.2 | 88.7 | 2.5 | B |
| Comp. 1 | B | B | 88.1 | 80.1 | 8.0 | C |
| Comp. 2 | A | A | 92.1 | 89.7 | 2.4 | C |
| Comp. 3 | A | A | 91.8 | 88.2 | 3.6 | C |
| Comp. 4 | B | A | 94.0 | 92.3 | 1.7 | A |

TABLE 10

| HT/HH (30° C./80% RH) | | | | | | | | |
|---|---|---|---|---|---|---|---|---|
| | Initial | | | After 10000 sheets | | | After standing for 1 day | |
| Example | I.D. | Fog | Dot | I.D. | Fog | Dot | I.D. | Fog |
| 9 | 1.49 | 1.2 | 98 | 1.47 | 1.3 | 97 | 1.45 | 1.3 |
| 10 | 1.45 | 1.6 | 99 | 1.44 | 1.8 | 95 | 1.42 | 1.7 |
| Comp. 5 | 1.38 | 1.2 | 95 | 1.32 | 1.5 | 90 | 1.30 | 1.4 |
| Comp. 6 | 1.21 | 1.6 | 88 | 1.15 | 2.3 | 85 | 1.08 | 2.3 |

TABLE 11

| NT/NH (23.5° C./60% RH) | | | | | | | | |
|---|---|---|---|---|---|---|---|---|
| | Initial | | | After 10000 sheets | | | After standing for 1 day | |
| Example | I.D. | Fog | Dot | I.D. | Fog | Dot | I.D. | Fog |
| 9 | 1.47 | 1.2 | 99 | 1.46 | 1.3 | 97 | 1.45 | 1.3 |
| 10 | 1.44 | 1.5 | 99 | 1.44 | 1.6 | 96 | 1.43 | 1.5 |
| Comp. 5 | 1.37 | 1.3 | 96 | 1.35 | 1.9 | 90 | 1.30 | 2.0 |
| Comp. 6 | 1.20 | 1.9 | 89 | 1.17 | 2.3 | 82 | 1.10 | 2.4 |

TABLE 12

| LT/LH (15° C./10% RH) | | | | | | | | |
|---|---|---|---|---|---|---|---|---|
| | Initial | | | After 10000 sheets | | | After standing for 1 day | |
| Example | I.D. | Fog | Dot | I.D. | Fog | Dot | I.D. | Fog |
| 9 | 1.45 | 1.1 | 99 | 1.43 | 1.3 | 98 | 1.43 | 1.3 |
| 10 | 1.44 | 0.8 | 100 | 1.44 | 1.1 | 97 | 1.43 | 1.0 |
| Comp. 5 | 1.40 | 1.3 | 97 | 1.37 | 2.0 | 92 | 1.33 | 2.1 |
| Comp. 6 | 1.35 | 2.1 | 89 | 1.30 | 3.5 | 80 | 1.21 | 3.4 |

TABLE 13

| Fixing, transfer and cleaning performances | | | | | |
|---|---|---|---|---|---|
| | | Anti- | | Photosensitive member | |
| Example | Fixability | offset | Transferability | Soiling | Cleanability |
| 9 | B | A | A | A | A |
| 10 | A | A | A | A | A |
| Comp. 5 | B | B | D | D | B |
| Comp. 6 | B | A | A | A | D |

What is claimed is:

1. A toner comprising: toner particles each comprising at least a binder resin and magnetic iron oxide, wherein the toner has a weight-average particle size X (μm) of 4–12 μm;

the toner contains particles of at least 3 μm which include:

at least 85% by number particles satisfying a circularity Ci of at least 0.900 according to formula (1) below:

$$Ci=L_0/L \quad (1),$$

wherein in L denotes a peripheral length of a projection image of an individual particle as measured at an image processing resolution of 512×512 pixels (each having a pixel size of 0.3 μm×0.3 μm), and $L_0$ denotes a peripheral length of a circle giving an identical area as the projection image, and a number-basis percentage Y (%) of particles having a circularity Ci of at least 0.95 0 according to the formula (1) above satisfying a relationship of formula (2) below with respect to the weight-average particle size X (μm) of the toner;

$$Y \geq X^{-0.715} \times \exp 5.31 \quad (2); \text{ and}$$

the toner provides an extract solution showing an absorbance of 1.0–2.5 at a wavelength of 340 nm when the extract solution is obtained by extracting 20 mg of the toner with 5 ml of 3 mol/l-hydrochloric acid for 50 min.

2. The toner according to claim 1, wherein the extract solution of the toner shows an absorbance of 1.3–2.3 at a wavelength of 340 nm.

3. The toner according to claim 1, wherein 20–200 parts of the magnetic iron oxide is contained per 100 wt. parts of the binder resin.

4. A process for producing a toner comprising:

a step of melt-kneading a mixture comprising at least a binder resin and magnetic iron oxide to provide a melt-kneaded mixture;

a step of cooling the melt-kneaded mixture, a pulverizing step of pulverizing the cooled melt-kneaded mixture by a pulverizing means to provide a pulverizate, a step of classifying the pulverizate to provide toner particles, and a surface-treatment step of surface-treating the toner particles to provide a toner;

wherein the pulverizing means includes a mechanical pulverizer comprising a rotor affixed to a central rotation shaft and a stator disposed around and with a prescribed gap from the rotor for pulverizing a powdery feed in the gap, and in the surface-treatment step, the toner particles are surface-treated by passing the toner particles through a surface treatment apparatus for continuously applying a mechanical impact force to the toner particles, whereby the resultant toner has a weight-average particle size X ($\mu$m) of 4–12 $\mu$m;

the toner contains particles of at least 3$\mu$ which include:

at least 85% by number of particles satisfying a circularity Ci of at least 0.900 according to formula (1) below:

$$Ci=L_0/L \quad (1),$$

wherein in L denotes a peripheral length of a projection image of an individual particle as measured at an image processing resolution of 512×512 pixels (each having a pixel size of 0.3 $\mu$m×0.3 $\mu$m), and $L_0$ denotes a peripheral length of a circle giving an identical area as the projection image, and a number-basis percentage Y (%) of particles having a circularity Ci of at least 0.950 according to the formula (1) above satisfying a relationship of formula (2) below with respect to the weight-average particle size X ($\mu$m) of the toner;

$$Y \geqq X^{-0.715} \times \exp 5.31 \quad (2); \text{ and}$$

the toner provides an extract solution showing an absorbance of 1.0–2.5 at a wavelength of 340 nm when the extract solution is obtained by extracting 20 mg of the toner with 5 ml of 3 mol/l-hydrochloric acid for 50 min.

5. The process according to claim 4, wherein the extract solution of the toner shows an absorbance of 1.3–2.3 at a wavelength of 340 nm.

6. The process according to claim 4, wherein 20–200 parts of the magnetic iron oxide is contained per 100 wt. parts of the binder resin.

7. An image-forming method comprising:

a latent-image forming step of forming an electrostatic image on an image-bearing member; a developing step of developing the electrostatic image on the image-bearing member with toner to form a toner image; a transfer step of transferring the toner image from the image-bearing member onto a secondary medium via or without via an intermediate transfer member; and a fixing step of fixing the toner image onto the recording medium;

wherein the developing step also functions as a step of recovering transfer residual toner remaining on the image-bearing member after transfer of the toner image from the image-bearing member in addition to formation of the toner image on the image-bearing member; and the toner comprising toner particles each comprising at least a binder resin and magnetic iron oxide, wherein the toner has a weight-average particle size X ($\mu$m) of 4–12 $\mu$m;

the toner contains particles of at least 3 $\mu$m which include:

at least 85% by number particles satisfying a circularity Ci of at least 0.900 according to formula (I) below:

$$Ci=L_0/L \quad (1)$$

wherein in L denotes a peripheral length of a projection image of an individual particle, as measured at an image processing resolution of 512×512 pixels (each having a pixel size of 0.3 $\mu$m×0.3 $\mu$m), and $L_0$ denotes a peripheral length of a circle giving an identical area as the projection image, and a number-basis percentage Y (%) of particles having a circularity Ci of at least 0.950 according to the formula (1) above satisfying a relationship of formula (2) below with respect to the weight-average particle size X ($\mu$m) of the toner;

$$Y \geqq X^{-0.715} \times \exp 5.31 \quad (2); \text{ and}$$

the toner provides an extract solution showing an absorbance of 1.0–2.5 at a wavelength of 340 nm when the extract solution is obtained by extracting 20 mg of the toner with 5 ml of 3 mol/l-hydrochloric acid for 50 min.

8. The method according to claim 7, wherein a multi-color image is formed.

9. The method according to claim 7, wherein the extract solution of the toner shows an absorbance of 1.3–2.3 at a wavelength of 340 nm.

10. The method according to claim 7, wherein 20–200 parts of the magnetic iron oxide is contained per 100 wt. parts of the binder resin.

* * * * *

UNITED STATES PATENT AND TRADEMARK OFFICE

CERTIFICATE OF CORRECTION

PATENT NO. : 6,875,549 B2
APPLICATION NO. : 10/117232
DATED : April 5, 2005
INVENTOR(S) : Katsuhisa Yamazaki et al.

It is certified that error appears in the above-identified patent and that said Letters Patent is hereby corrected as shown below:

COLUMN 1:

Line 34, “id” should be deleted; and
Line 53, “a” should be deleted.

COLUMN 2:

Line 30, “a” should be deleted.

COLUMN 4:

Line 3, close up right margin; and
Line 4, close up left margin.

COLUMN 8:

Line 36, “Surfaces>” should read --Surfaces)>--.

COLUMN 25:

Complex 7, “xomplex” should read --complex--; and
Complex 8, “xomplex” should read --complex--.

COLUMN 28:

Line 61, “$3x10^{-5 - 1x10-3}$” should read --$3x10^{-5}$ - $1x10^{-3}$--.

COLUMN 30:

Line 32, “are” should read --is--.

COLUMN 31:

Line 6, “a moment” should read --an interval--.

COLUMN 32:

Line 24, “ca” should read --can--.

UNITED STATES PATENT AND TRADEMARK OFFICE

CERTIFICATE OF CORRECTION

PATENT NO. : 6,875,549 B2
APPLICATION NO. : 10/117232
DATED : April 5, 2005
INVENTOR(S) : Katsuhisa Yamazaki et al.

It is certified that error appears in the above-identified patent and that said Letters Patent is hereby corrected as shown below:

COLUMN 34:

Line 31, “point-arrange” should read --point-average--.

COLUMN 36:

Line 2, “e” should read --be--.

COLUMN 38:

Line 61, “driver” should read --driven--.

COLUMN 39:

Line 59, “supplied” should read --was supplied--.

COLUMN 41:

Line 46, “ozonless-type” should read --ozoneless type--.

COLUMN 42:

Line 55, “scone” should read --scope--.

COLUMN 44:

Line 9, “Magnetic” should read --magnetic--.

COLUMN 45:

Line 30, “were” should read --was--.

COLUMN 52:

Line 5, “Fog” should read --fog--.

COLUMN 56:

Line 31, “0.95 0” should read --0.950--.

UNITED STATES PATENT AND TRADEMARK OFFICE

CERTIFICATE OF CORRECTION

PATENT NO. : 6,875,549 B2
APPLICATION NO. : 10/117232
DATED : April 5, 2005
INVENTOR(S) : Katsuhisa Yamazaki et al.

It is certified that error appears in the above-identified patent and that said Letters Patent is hereby corrected as shown below:

COLUMN 57:

Line 5, "3μ" should read --3μm--.

COLUMN 58:

Line 17, "in" should be deleted.

Signed and Sealed this

Tenth Day of April, 2007

JON W. DUDAS
*Director of the United States Patent and Trademark Office*